US010885865B2

(12) United States Patent
Imajo et al.

(10) Patent No.: US 10,885,865 B2
(45) Date of Patent: Jan. 5, 2021

(54) DRIVE CIRCUIT, DISPLAY DEVICE, AND DRIVE METHOD

(71) Applicant: Panasonic Liquid Crystal Display Co., Ltd., Himeji (JP)

(72) Inventors: Yoshihiro Imajo, Hyogo (JP); Kazunori Inoue, Osaka (JP); Kenta Endo, Hyogo (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 0 days.

(21) Appl. No.: 16/783,883

(22) Filed: Feb. 6, 2020

(65) Prior Publication Data

US 2020/0175937 A1 Jun. 4, 2020

Related U.S. Application Data

(60) Division of application No. 15/901,386, filed on Feb. 21, 2018, now Pat. No. 10,593,281, which is a (Continued)

(30) Foreign Application Priority Data

Aug. 21, 2015 (JP) ..... 2015-164029
Sep. 2, 2015 (JP) ..... 2015-173233

(51) Int. Cl.
*G09G 3/36* (2006.01)
*G09G 3/20* (2006.01)

(52) U.S. Cl.
CPC ..... *G09G 3/3677* (2013.01); *G09G 3/20* (2013.01); *G09G 2310/0286* (2013.01); (Continued)

(58) Field of Classification Search
CPC ..... G09G 3/3677; G09G 3/20; G09G 2310/0286; G09G 2310/0289
(Continued)

(56) References Cited

U.S. PATENT DOCUMENTS 6,124,840 A 9/2000 Kwon
6,642,916 B1 11/2003 Kodama et al.
(Continued)

FOREIGN PATENT DOCUMENTS

JP H1130975 A 2/1999
JP 2003066917 A 3/2003
(Continued)

*Primary Examiner* — Jonathan M Blancha
(74) *Attorney, Agent, or Firm* — Hamre, Schumann, Mueller & Larson, P.C.

(57) ABSTRACT

A drive circuit includes an output circuit provided in a display panel to output a gate-on voltage and a gate-off voltage to a plurality of gate lines. The plurality of gate lines include first to sixth gate lines sequentially disposed in a scanning direction. A first transistor is put into an on state to electrically connect the first gate line and the third gate line, a second transistor is put into the on state to electrically connect the second gate line and the fourth gate line, the third transistor is put into the on state to electrically connect the third gate line and the fifth gate line, and the fourth transistor is put into the on state to electrically connect the fourth gate line and the sixth gate line, after the output circuit outputs the gate-on voltage to the first to fourth gate line.

14 Claims, 22 Drawing Sheets

Related U.S. Application Data continuation of application No. PCT/JP2016/003752, filed on Aug. 17, 2016.

(52) U.S. Cl.
CPC ..... *G09G 2310/0289* (2013.01); *G09G 2310/0291* (2013.01); *G09G 2330/021* (2013.01)

(58) Field of Classification Search
USPC ..... 345/100
See application file for complete search history.

(56) References Cited

U.S. PATENT DOCUMENTS

2004/0041763 A1* 3/2004 Kodama ..... G09G 3/3688 345/87
2006/0114209 A1 6/2006 Kim et al.
2007/0296661 A1 12/2007 Ishiguchi
2009/0256832 A1 10/2009 Ding
2010/0109995 A1* 5/2010 Fang ..... G09G 3/3677 345/100
2010/0245301 A1* 9/2010 Shang ..... G11C 19/28 345/204
2015/0339999 A1* 11/2015 Zheng ..... G09G 3/3677 345/92
2016/0035304 A1* 2/2016 Zheng ..... G02F 1/13454 345/211

FOREIGN PATENT DOCUMENTS

JP 2006154712 A 6/2006
JP 2008008928 A 1/2008
JP 2009258733 A 11/2009

* cited by examiner

DRIVE CIRCUIT, DISPLAY DEVICE, AND DRIVE METHOD

CROSS-REFERENCE TO RELATED APPLICATION

This application is a bypass continuation of international patent application PCT/JP2016/003752, filed on Aug. 17, 2016 designating the United States of America. Priority is claimed based on Japanese patent application JP2015-164029, filed on Aug. 21, 2015 and Japanese patent application JP2015-173233, filed on Sep. 2, 2015. The entire disclosures of these international and Japanese patent applications are incorporated herein by reference in their entirety.

TECHNICAL FIELD

The present disclosure relates to a drive circuit, a display device and a drive method.

BACKGROUND

For example, in a liquid crystal display device among various display devices, an electric field generated between a pixel electrode and a common electrode, which are formed in each pixel region, is applied to liquid crystal to drive the liquid crystal, thereby adjusting an amount of light transmitted through a region between the pixel electrode and the common electrode to display an image.

Conventionally, various techniques have been proposed in the liquid crystal display device in order to reduce power consumption. For example, in a configuration disclosed in a prior art (See Unexamined Japanese Patent Publication No. 2008-008928), a source driver supplies positive-polarity and negative-polarity source signals having a predetermined voltage to source lines in a vertical blanking period, and the source driver is electrically separated from the source lines after the supply of the source signals while adjacent source lines to which the negative-polarity source signal is supplied are short-circuited, whereby a predetermined DC voltage value is held in the source line.

However, in the conventional technique, the power consumption is not sufficiently reduced as a whole liquid crystal display device. In particular, in recent years, the liquid crystal display device tends to be made higher in definition and to increase power consumption, and thus it is necessary to further save the power consumption. Because the liquid crystal display device is also required to be made thinner and narrowed, it is necessary to avoid a complicated circuit configuration in reducing the power consumption.

The present disclosure is made in view of the above circumstances, and an object of the present disclosure is to provide a drive circuit, a display device, and a drive method for reducing the power consumption without a complicated circuit configuration.

SUMMARY

In one general aspect, the instant application describes a drive circuit including an output circuit provided in a display panel to output a gate-on voltage and a gate-off voltage to a plurality of gate lines, a first transistor in which one of conductive electrodes is electrically connected to the first gate line while another conductive electrode is electrically connected to the second gate line, and a first control line electrically connected to a control electrode of the first transistor. The plurality of gate lines include a first gate line and a second gate line disposed in a scanning direction with respect to the first gate line. After the output circuit outputs the gate-on voltage to the first gate line, the first transistor is put into an on state to electrically connect the first gate line and the second gate line.

The above general aspect may include one or more of the following features. When the output circuit outputs the gate-on voltage to the first gate line, the first transistor may be put into the on state to electrically connect the first gate line and the second gate line.

Before the output circuit outputs the gate-on voltage to the second gate line, the first transistor may be put into the on state.

When the first gate line and the second gate line are in a floating state, the first transistor may be put into the on state.

The first transistor may be put into the on state to distribute part of a charge charged in the first gate line to the second gate line.

The drive circuit may further include a second transistor in which one of conductive electrodes is electrically connected to the second gate line while another conductive electrode is connected to a third gate line; and a second control line electrically connected to a control electrode of the second transistor. The plurality of gate lines may include the first gate line, the second gate line, and the third gate line, which are sequentially disposed in the scanning direction. After the output circuit outputs the gate-on voltage to the second gate line, the second transistor may be put into the on state to electrically connect the second gate line and the third gate line.

The first transistor and the second transistor may be alternately disposed in the scanning direction.

The gate-on voltage having an inclination in rising and falling of a signal waveform may be output.

The drive circuit may further comprise a resistor electrically connected to the conductive electrode of the transistor.

Size of a channel portion of the transistor may be adjusted such that the inclination is formed in the signal waveform of the gate-on voltage.

A display device includes a display panel provided with a plurality of gate lines and the drive circuit.

In another general aspect, a drive circuit of the instant application includes an output circuit provided in a display panel to output a gate-on voltage and a gate-off voltage to a plurality of gate lines, the plurality of gate lines including first to sixth gate lines sequentially disposed in a scanning direction, a first transistor in which one of conductive electrodes is electrically connected to the first gate line while another conductive electrode is electrically connected to the third gate line, a second transistor in which one of conductive electrodes is electrically connected to the second gate line while another conductive electrode is electrically connected to the fourth gate line, a third transistor in which one of conductive electrodes is electrically connected to the third gate line while another conductive electrode is electrically connected to the fifth gate line, a fourth transistor in which one of conductive electrodes is electrically connected to the fourth gate line while another conductive electrode is electrically connected to the sixth gate line, a first control line electrically connected to a control electrode of the first transistor, a second control line electrically connected to a control electrode of the second transistor, a third control line electrically connected to a control electrode of the third transistor; and a fourth control line electrically connected to a control electrode of the fourth transistor. The first transistor is put into an on state to electrically connect the first gate line and the third gate line after the output circuit outputs the gate-on voltage to the first gate line, the second transistor is put into the on state to electrically connect the second gate line and the fourth gate line after the output circuit outputs the gate-on voltage to the second gate line, the third transistor is put into the on state to electrically connect the third gate line and the fifth gate line after the output circuit outputs the gate-on voltage to the third gate line, and the fourth transistor is put into the on state to electrically connect the fourth gate line and the sixth gate line after the output circuit outputs the gate-on voltage to the fourth gate line.

The above general aspect may include one or more of the following features. The output circuit may output the gate-on voltage that becomes a high level in two horizontal scanning periods to each gate line every time one horizontal scanning period elapses.

In another general aspect, a method of the instant application is to drive a display device including a display panel and a drive circuit. The display panel is provided with a plurality of gate lines including a first gate line and a second gate line disposed in a scanning direction with respect to the first gate line. The drive circuit includes an output circuit that outputs a gate-on voltage and a gate-off voltage to the plurality of gate lines, a first transistor in which one of conductive electrodes is electrically connected to the first gate line while another conductive electrode is electrically connected to the second gate line, and a first control line electrically connected to a control electrode of the first transistor. The method includes putting the first transistor into an on state to electrically connect the first gate line and the second gate line after the output circuit outputs the gate-on voltage to the first gate line.

In another general aspect, a drive circuit of the instant application includes a first output circuit that outputs a gate-on voltage and a gate-off voltage to a first gate line, a second output circuit that outputs the gate-on voltage and the gate-off voltage to a second gate line disposed in a scanning direction with respect to the first gate line, a first transistor in which one of conductive electrodes is electrically connected to the first gate line, a second transistor in which one of conductive electrodes is electrically connected to the second gate line; and a connection wiring in which another conductive electrode of the first transistor and another conductive electrode of the second transistor are electrically connected to each other. The first transistor and the second transistor are put into an on state to electrically connect the first gate line and the second gate line through the connection wiring after the first output circuit outputs the gate-on voltage to the first gate line.

The above general aspect may include one or more of the following features. The drive circuit may further include a control transistor in which one of conductive electrodes is connected to the second output circuit while another conductive electrode is connected to a control electrode of the first transistor and a control electrode of the second transistor. The control electrodes are connected to a control line through which a control signal is supplied. After the first output circuit outputs the gate-on voltage to the first gate line, the control signal may be supplied to the control line and the control transistor is put into an on state to put the first transistor and the second transistor into the on state so as to electrically connect the first gate line and the second gate line through the connection wiring.

The first transistor and the second transistor may be disposed between the first gate line and the second gate line, the first gate line and the second gate line being adjacent to each other in the scanning direction. The first gate line and the second gate line may be electrically connected to each other through the connection wiring when the first transistor and the second transistor are in the on state.

The control transistor may be put into the on state to electrically connect the first gate line and the second gate line through the connection wiring when the first output circuit outputs the gate-on voltage to the first gate line.

The control transistor may be put into the on state to electrically connect the first gate line and the second gate line through the connection wiring before the second output circuit outputs the gate-on voltage to the second gate line.

The control transistor may be put into the on state to electrically connect the first gate line and the second gate line through the connection wiring when the first gate line and the second gate line are in a floating state.

The control transistor may be put into the on state to distribute part of a charge charged in the first gate line to the second gate line.

Each output circuit may include a shift register circuit and a delay circuit disposed at a subsequent stage of the shift register circuit. An output terminal of the shift register circuit may be electrically connected to the one of conductive electrodes of the control transistor and the delay circuit.

The connection wiring may be in a floating state when the control transistor is in an off state.

The connection wiring may include a first connection wiring and a second connection wiring, the other conductive electrode of the first transistor is electrically connected to the first connection wiring, the other conductive electrode of the second transistor is electrically connected to the second connection wiring, and the first connection wiring and the second connection wiring are electrically connected to each other through a resistor.

The other conductive electrodes of a plurality of the first transistors may be connected to the one first connection wiring. The other conductive electrodes of a plurality of the second transistors may be connected to the one second connection wiring, and the resistor may be disposed between the first connection wiring and the second connection wiring.

A resistance value of the resistor may be adjusted such that an inclination is formed in a signal waveform of the gate-on voltage.

A display device includes a display panel provided with a plurality of gate lines, and the drive circuit.

A display device includes a display panel provided with a plurality of gate lines; and the drive circuit. The drive circuit and the resistor may be separately disposed on a substrate constituting the display panel.

In another general aspect, a method of an instant application is to drive a display device including a display panel and a drive circuit. The display panel is provided with a plurality of gate lines including a first gate line and a second gate line disposed in a scanning direction with respect to the first gate line. The drive circuit includes a first output circuit that outputs a gate-on voltage and a gate-off voltage to the first gate line, a second output circuit that outputs the gate-on voltage and the gate-off voltage to the second gate line, a first transistor in which one of conductive electrodes is electrically connected to the first gate line, a second transistor in which one of conductive electrodes is electrically connected to the second gate line, and a connection wiring in which another conductive electrode of the first transistor and another conductive electrode of the second transistor are electrically connected to each other. The method includes putting the first transistor and the second transistor into an on state to electrically connect the first gate line and the second gate line through the connection wiring after the first output circuit outputs the gate-on voltage to the first gate line.

In another general aspect, a drive circuit of an instant application includes a first output circuit that outputs a gate-on voltage and a gate-off voltage to a first gate line, a second output circuit that outputs the gate-on voltage and the gate-off voltage to a second gate line disposed in a scanning direction with respect to the first gate line, a first transistor in which one of conductive electrodes is electrically connected to the first gate line while another conductive electrode is electrically connected to the second gate line; and a second transistor in which one of conductive electrodes is electrically connected to the second output circuit while another conductive electrode is electrically connected to a control electrode of the first transistor, the control electrode being connected to a control line through which a control signal is supplied. After the first output circuit outputs the gate-on voltage to the first gate line, the control signal may be supplied to the control line and the second transistor is put into an on state to put the first transistor into the on state so as to electrically connect the first gate line and the second gate line.

According to the configuration of the present disclosure, the drive circuit, the display device, and the drive method for reducing the power consumption without the complicated circuit configuration.

DETAILED DESCRIPTION

An embodiment of the present application is described below with reference to the drawings. The embodiment of the present application takes a liquid crystal display device as an example of a display device of the present application. However, the present application is not limited thereto, but the display device may be another kind of display, such as an organic EL display.

Figure 1:
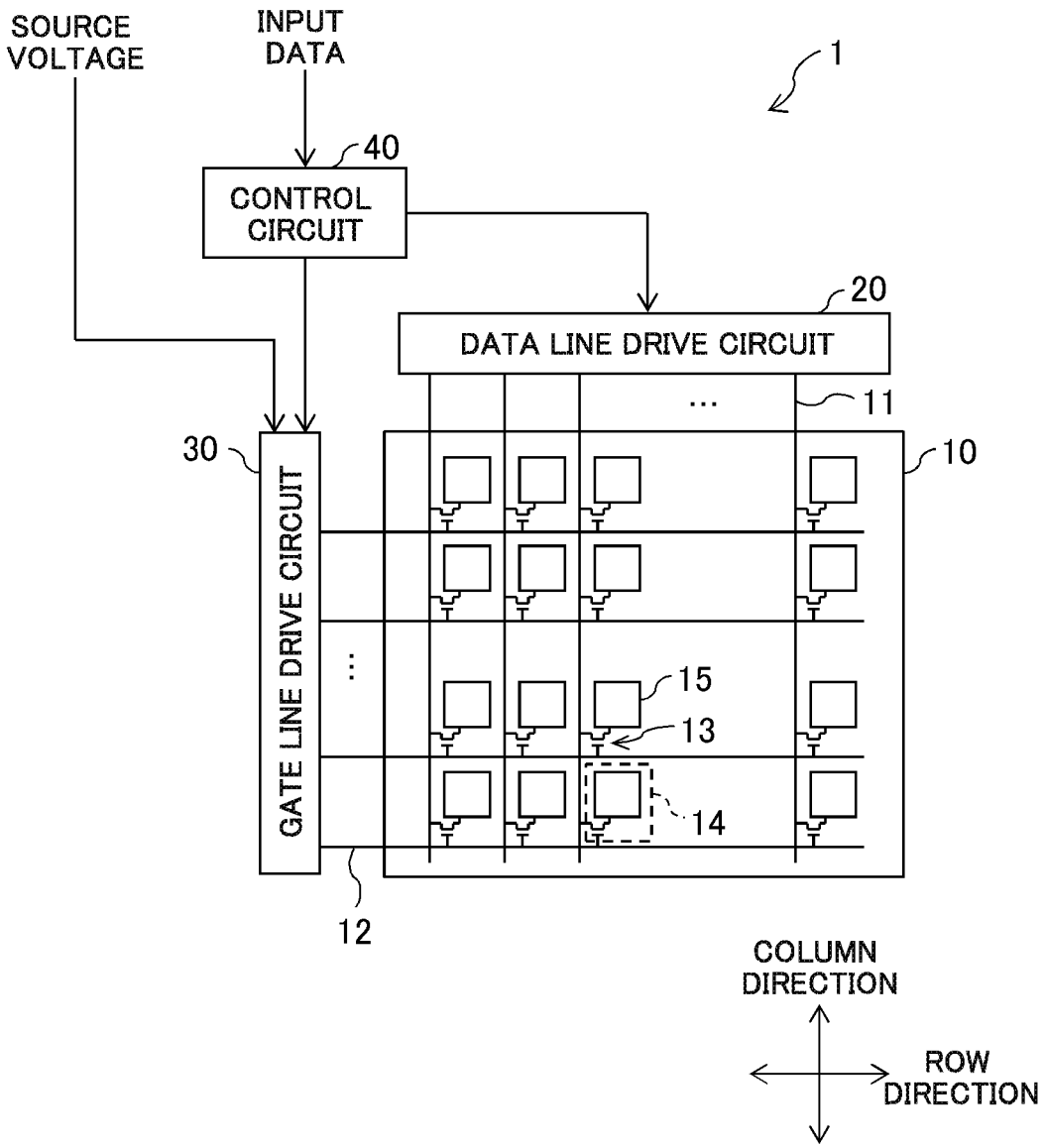
FIG. 1 is a plan view illustrating a schematic configuration of the liquid crystal display device according to the exemplary embodiment.

FIG. 1 is a plan view illustrating a schematic configuration of the liquid crystal display device according to the exemplary embodiment. Liquid crystal display device 1 includes display panel 10 that displays an image, a drive circuit (data line drive circuit 20, gate line drive circuit 30) that drives display panel 10, a control circuit 40 that controls the drive circuit, and a backlight (not illustrated) that irradiates display panel 10 with light from a rear surface side. The drive circuit may be provided in display panel 10.

A plurality of data lines 11 extending in a column direction and a plurality of gate lines 12 extending in a row direction are provided in display panel 10. Thin film transistor (TFT) 13 is provided in an intersection of each data line 11 and each gate line 12.

In display panel 10, a plurality of pixels 14 are arranged into a matrix shape (the row direction and the column direction) corresponding to the intersections of data lines 11 and gate lines 12. Although described in detail later, display panel 10 includes a thin film transistor substrate (TFT substrate), a color filter substrate (CF substrate), and a liquid crystal layer sandwiched between the TFT substrate and the CF substrate. A plurality of pixel electrodes 15 disposed corresponding to respective pixels 14 and one common electrode 16 common to respective pixels 14 are provided in TFT substrate. Common electrode 16 may be disposed while divided for each pixel 14 or each plurality of pixels 14, or provided on the CF substrate.

Control circuit 40 outputs various control signals for controlling drive timing of data line drive circuit 20 and gate line drive circuit 30, and image data corresponding to the image displayed on an image display region of display panel 10, based on externally-input input data (such as a synchronous signal and a video signal).

Data line drive circuit 20 outputs a data signal (data voltage) to each data line 11 based on the control signal and image data, which are input from control circuit 40.

Gate line drive circuit 30 generates a gate signal based on externally-input source voltage and the control signal input from control circuit 40 to output the gate signal to each gate line 12. A specific configuration of gate line drive circuit 30 will be described later.

Figure 2:
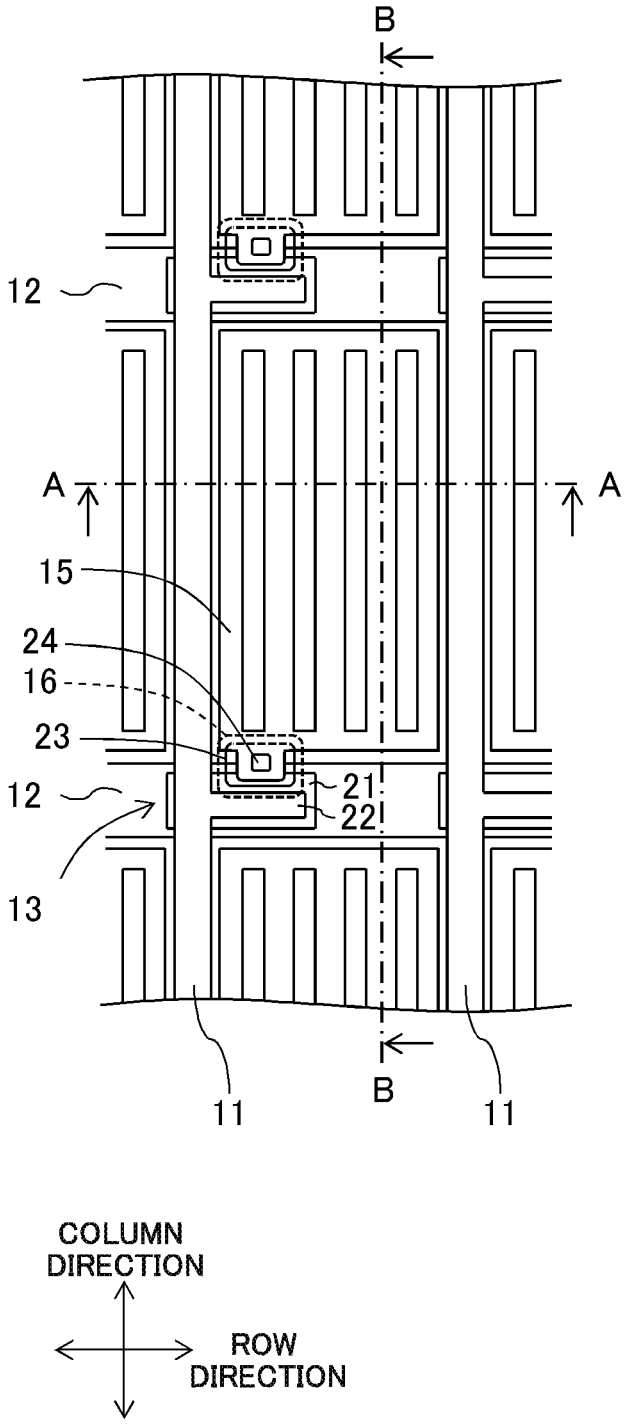
FIG. 2 is a plan view illustrating a configuration example of display panel.
Figure 3:
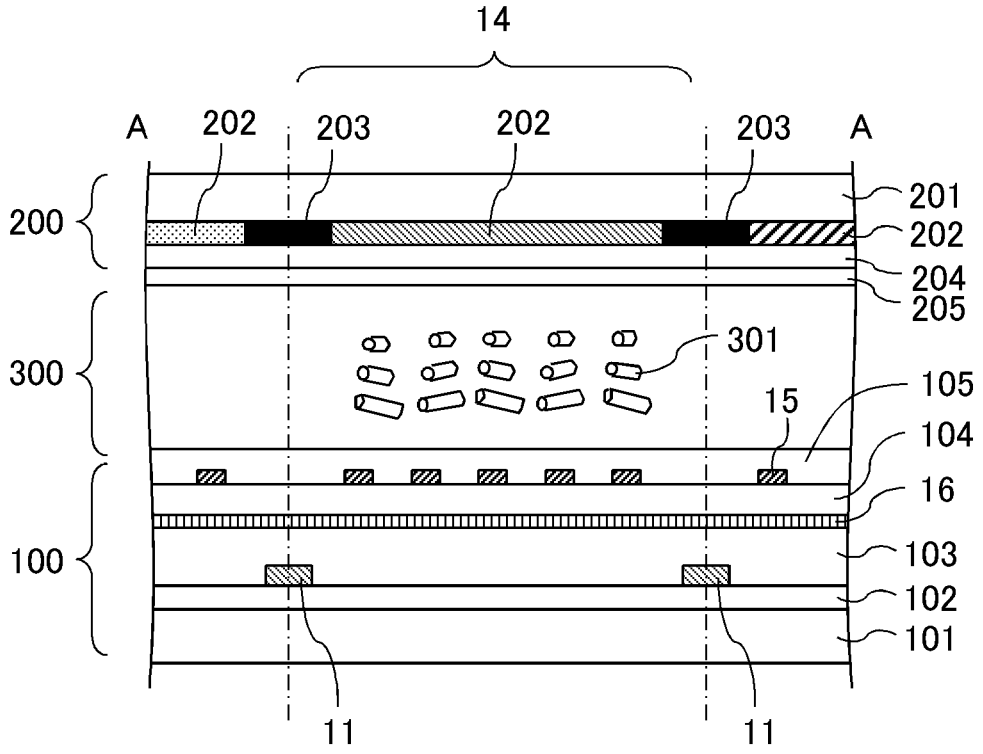
FIG. 3 is a sectional view taken along line A-A in FIG. 2.
Figure 4:
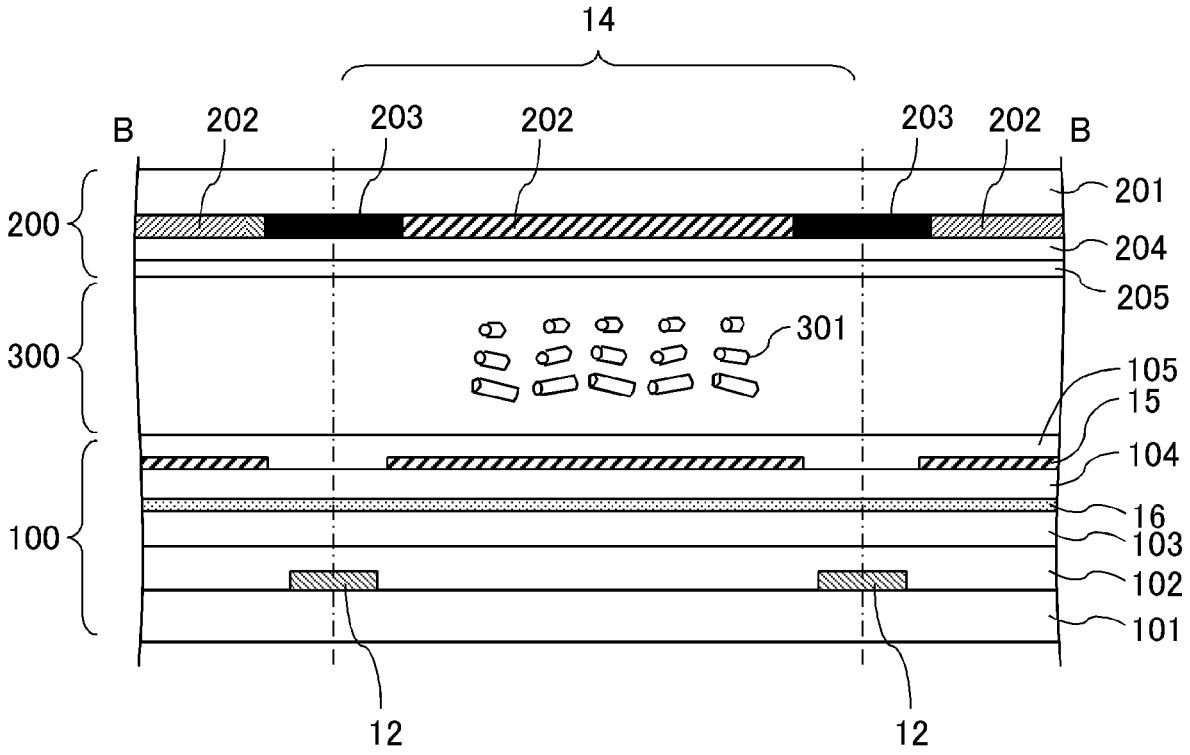
FIG. 4 is a sectional view taken along line B-B in FIG. 2.

FIG. 2 is a plan view illustrating a configuration example of display panel 10. FIG. 3 is a sectional view taken along line A-A in FIG. 2, and FIG. 4 is a sectional view taken along line B-B in FIG. 2. A specific configuration of display panel 10 will be described with reference to FIGS. 2 to 4.

In FIG. 2, a region partitioned by two adjacent data lines 11 and two adjacent gate lines 12 corresponds to one pixel 14. Thin film transistor 13 is provided in each pixel 14. Thin film transistor 13 includes semiconductor layer 21 formed on insulator 102 (see FIG. 3), and drain electrode 22 and source electrode 23 which are formed on semiconductor layer 21 (see FIG. 2). Drain electrode 22 is electrically connected to data line 11, and source electrode 23 is electrically connected to pixel electrode 15 through through-hole 24.

Pixel electrode 15 made of a transparent conductive film such as indium tin oxide (ITO) is formed in each pixel 14. Pixel electrode 15 includes a plurality of openings, and is formed into a stripe shape. There is no limitation on a shape of the opening. One common electrode 16 made of the transparent conductive film such as ITO is formed in common to each pixel 14 over a display region. An opening is formed in a region where common electrode 16 overlaps with through-hole 24 and source electrode 23 of thin film transistor 13 in order to electrically connect pixel electrode 15 and source electrode 23.

As illustrated in FIG. 3, display panel 10 includes TFT substrate 100, CF substrate 200, and liquid crystal layer 300 sandwiched between TFT substrate 100 and CF substrate 200.

In TFT substrate 100, gate line 12 (see FIG. 4) is formed on glass substrate 101, and insulator 102 is formed so as to cover gate line 12. Data line 11 (FIG. 3) is formed on insulator 102, and insulator 103 is formed so as to cover data line 11. Common electrode 16 is formed on insulator 103, and insulator 104 is formed so as to cover common electrode 16. Pixel electrode 15 is formed on insulator 104, and alignment film 105 is formed so as to cover pixel electrode 15. Although not illustrated, a polarizing plate and the like are formed in TFT substrate 100. A laminate structure of each unit constituting pixel 14 is not limited to the configurations in FIGS. 3 and 4, but any known configuration can be adopted.

In CF substrate 200, black matrix 203 and colored portion 202 (for example, a red portion, a green portion, and a blue portion) are formed on glass substrate 201, and overcoat layer 204 is formed so as to cover black matrix 203 and colored portion 202. Alignment film 205 is formed on overcoat layer 204. Although not illustrated, a polarizing plate and the like are formed in CF substrate 200.

Liquid crystal 301 is enclosed in liquid crystal layer 300. Liquid crystal 301 may be negative type liquid crystal having a negative dielectric anisotropy, or positive type liquid crystal having a positive dielectric anisotropy.

Alignment film 105, 205 may be an alignment film subjected to a rubbing alignment treatment, or a photo-alignment film subjected to a photo-alignment treatment.

As described above, liquid crystal display device 1 has the configuration of in-plane switching (IPS) system. The configuration of liquid crystal display device 1 is not limited to the above configuration.

A method for driving liquid crystal display device 1 will briefly be described. A scanning gate voltage (gate-on voltage, gate-off voltage) is supplied from gate line drive circuit 30 to gate line 12. A video data voltage is supplied from data line drive circuit 20 to data line 11. When the gate-on voltage is supplied to gate line 12, thin film transistor 13 is turned on, and the data voltage supplied to data line 11 is transmitted to pixel electrode 15 through drain electrode 22 and source electrode 23. Common voltage (Vcom) is supplied from a common electrode drive circuit (not illustrated) to common electrode 16. Common electrode 16 overlaps pixel electrode 15 with insulator 104 interposed therebetween, and an opening (slit) is formed in pixel electrode 15. Consequently, liquid crystal 301 is driven by an electric field from pixel electrode 15 to common electrode 16 through liquid crystal layer 300 and the opening of pixel electrode 15. Liquid crystal 301 is driven to control transmittance of light transmitted through liquid crystal layer 300, thereby displaying the image. For performing color display, a desired data voltage is supplied to data line connected to pixel electrode 15 of pixel 14 corresponding to each of the red portion, green portion, and blue portion, which are formed by a vertical stripe color filter. The method for driving liquid crystal display device 1 is not limited to the above method, but any known method may be adopted.

First Configuration Example

Figure 5:
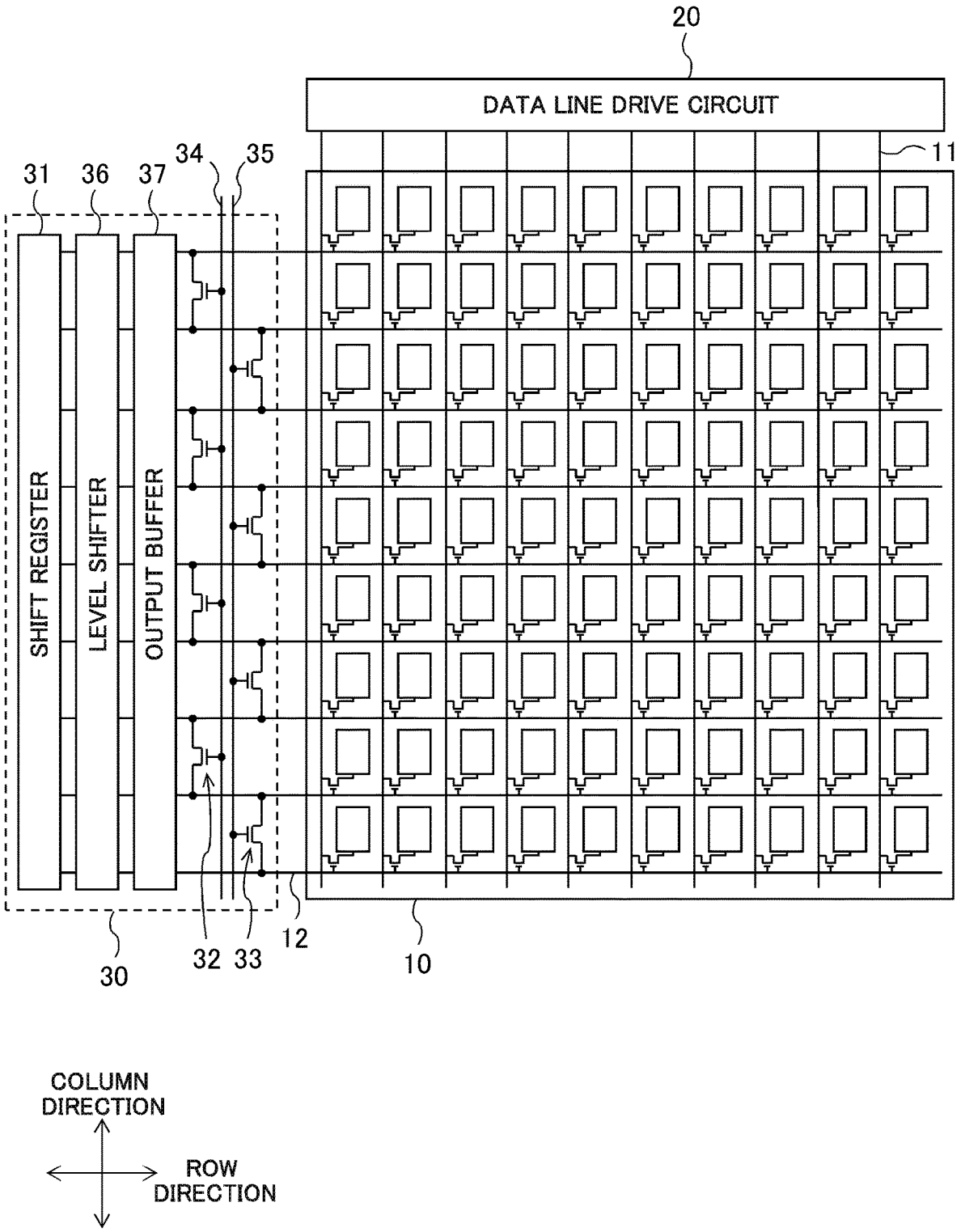
FIG. 5 is a plan view illustrating a schematic configuration of gate line drive circuit of the first configuration example.
Figure 6:
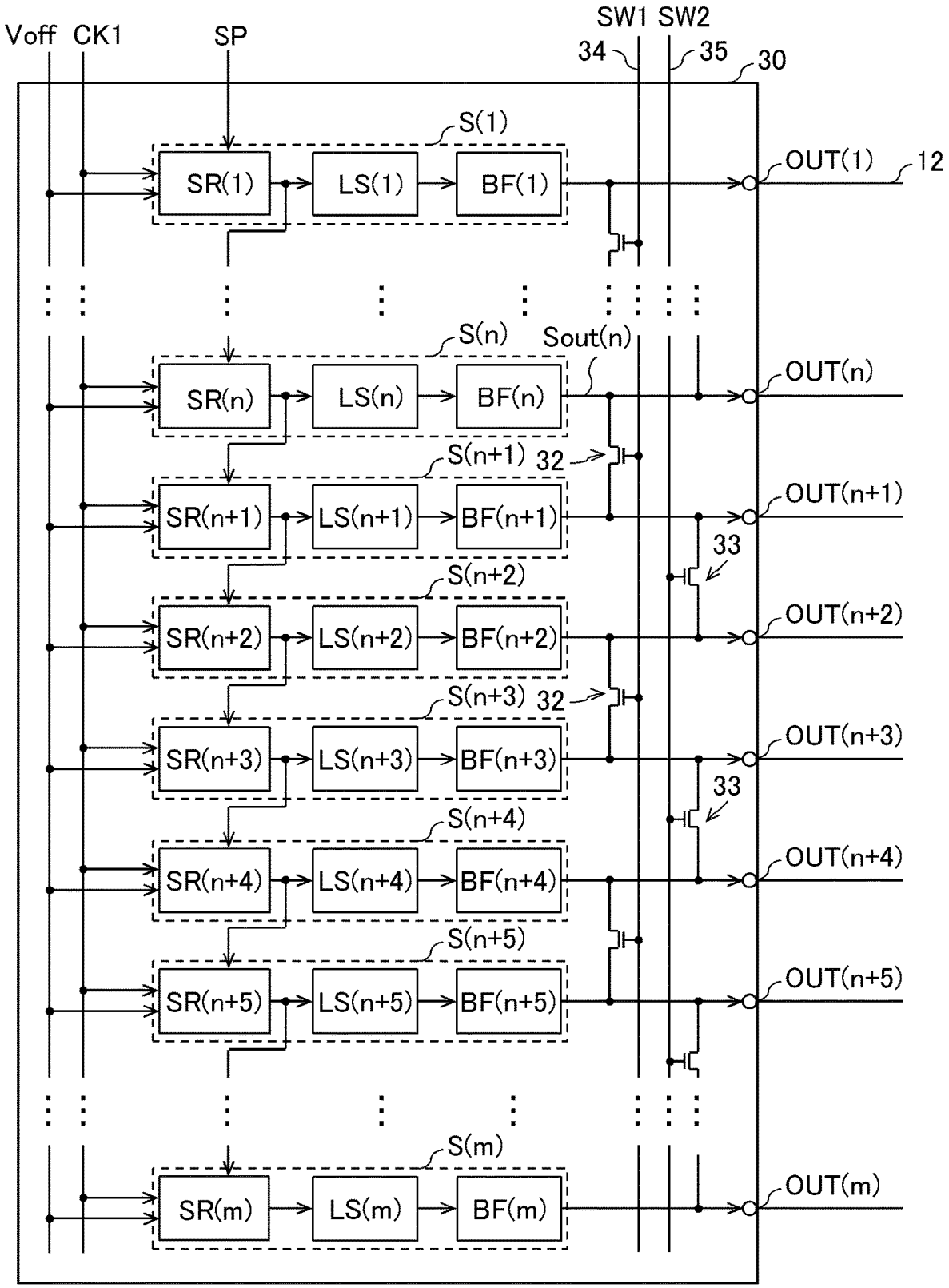
FIG. 6 is a plan view illustrating a specific configuration of gate line drive circuit of the first configuration example.

A specific configuration of gate line drive circuit 30 according to a first configuration example will be described below. FIG. 5 is a plan view illustrating a schematic configuration of gate line drive circuit 30 of the first configuration example. FIG. 6 is a plan view illustrating a specific configuration of gate line drive circuit 30 of the first configuration example. Gate line drive circuit 30 of the first configuration example includes shift register 31 including a plurality of shift register circuits SR, level shifter 36 including a plurality of level shifter circuits LS, output buffer 37 including a plurality of buffer circuits BF, a plurality of first transistors 32 and a plurality of second transistors 33, which are electrically connected to two adjacent gate lines 12, first control line 34 that is electrically connected to gate electrodes (control electrodes) of the plurality of first transistors 32, and second control line 35 that is electrically connected to gate electrodes (control electrodes) of the plurality of second transistors 33. First transistor 32 and second transistor 33 are alternately disposed in the column direction. For example, first transistor 32 is disposed between gate lines 12 of first and second rows, between gate lines 12 of third and fourth rows, and between gate lines 12 of nth (n is an odd number) and (n+1)th rows. Second transistor 33 is disposed between gate lines 12 of second and third rows, between gate lines 12 of fourth and fifth rows, and between gate lines 12 of (n+1)th and (n+2)th rows. In each transistor, one of conductive electrodes is electrically connected to first gate line 12 while the other conductive electrode is electrically connected to a second gate line disposed in the scanning direction with respect to the first gate line.

Clock CK1 and gate-off voltage Voff are input to each shift register circuit SR. Start pulse SP is input to first-stage shift register circuit SR(1), and an output signal of preceding-stage shift register circuit SR is input to shift register circuits SR from second and following stages. Each level shifter circuit LS converts a voltage level of the output signal of each shift register circuit SR, and outputs the signal to subsequent each buffer circuit BF. Each buffer circuit BF amplifies the signal converted by each level shifter circuit LS, and outputs the gate signal (the gate-on voltage/the gate-off voltage) to each gate line 12. Shift register circuit SR, level shifter circuit LS, and buffer circuit BF of each stage constitute output circuit S of each stage. That is, nth-stage output circuit S(n) includes shift register circuit SR(n), level shifter circuit LS(n), and buffer circuit BF(n), and outputs output signal Sout(n) corresponding to gate signal Gout(n).

First control signal SW1 for turning on and off first transistor 32 is supplied to the gate electrode of first transistor 32 through first control line 34. Second control signal SW2 for turning on and off second transistor 33 is supplied to the gate electrode of second transistor 33 through second control line 35. Output signals Sout(1) to Sout(m) of output circuits S(1) to S(m) are subjected to processing (charge distribution processing) according to the operation to turn on and off first transistor 32 and second transistor 33 using first control signal SW1 and second control signal SW2, and are sequentially output as gate signals Gout(1) to Gout(m) from output terminals OUT(1) to OUT(m) to gate lines 12 of first to mth rows. A specific example of the charge distribution processing will be described later.

Figure 7:
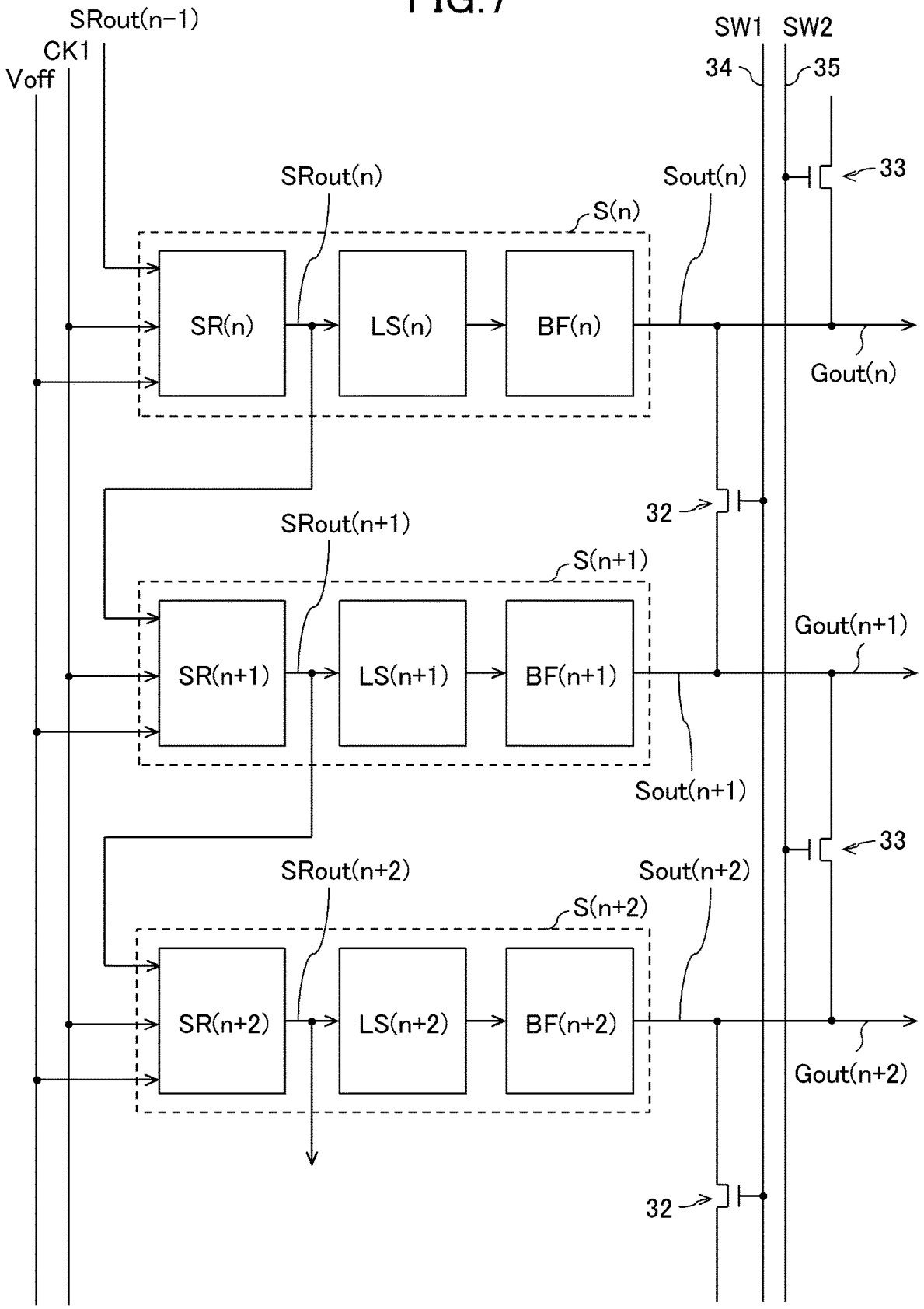
FIG. 7 is a view illustrating a configuration example of output circuit of the first configuration example.

A known configuration can be adopted to each shift register circuit SR, each level shifter 36, and each output buffer 37. FIG. 7 is a view illustrating a configuration example of output circuit S of the first configuration example. FIG. 7 illustrates nth-stage (n is an odd number) shift register circuit SR(n), (n+1)th-stage shift register circuit SR(n+1), (n+2)th-stage shift register circuit SR(n+2), and level shifter circuit LS and buffer circuit BF, which correspond to nth-stage shift register circuit SR(n), (n+1)th-stage shift register circuit SR(n+1), and (n+2)th-stage shift register circuit SR(n+2). A clock line is connected to a clock terminal of shift register circuit SR, and clock CK1 is input to the clock terminal. An off-signal line is connected to a reset terminal of shift register circuit SR, and gate-off voltage Voff (reset signal) is input to the reset terminal in order to turn off thin film transistor 13.

Output signal SRout(n−1) output from shift register circuit SR(n−1) of a preceding stage is input to an input terminal of shift register circuit SR(n). When output signal SRout(n−1) is input to the input terminal while clock CK1 is input to the clock terminal, shift register circuit SR(n) outputs a pulse signal (a low level, a high level) corresponding to clock CK1 as output signal SRout(n). While output signal SRout(n) is input to shift register circuit SR(n+1) of the subsequent stage, level shifter circuit LS(n) and buffer circuit BF(n) convert output signal SRout(n) into output signal Sout(n). Output signal Sout(n) is supplied to gate line 12 as gate signal Gout(n).

Figure 8:
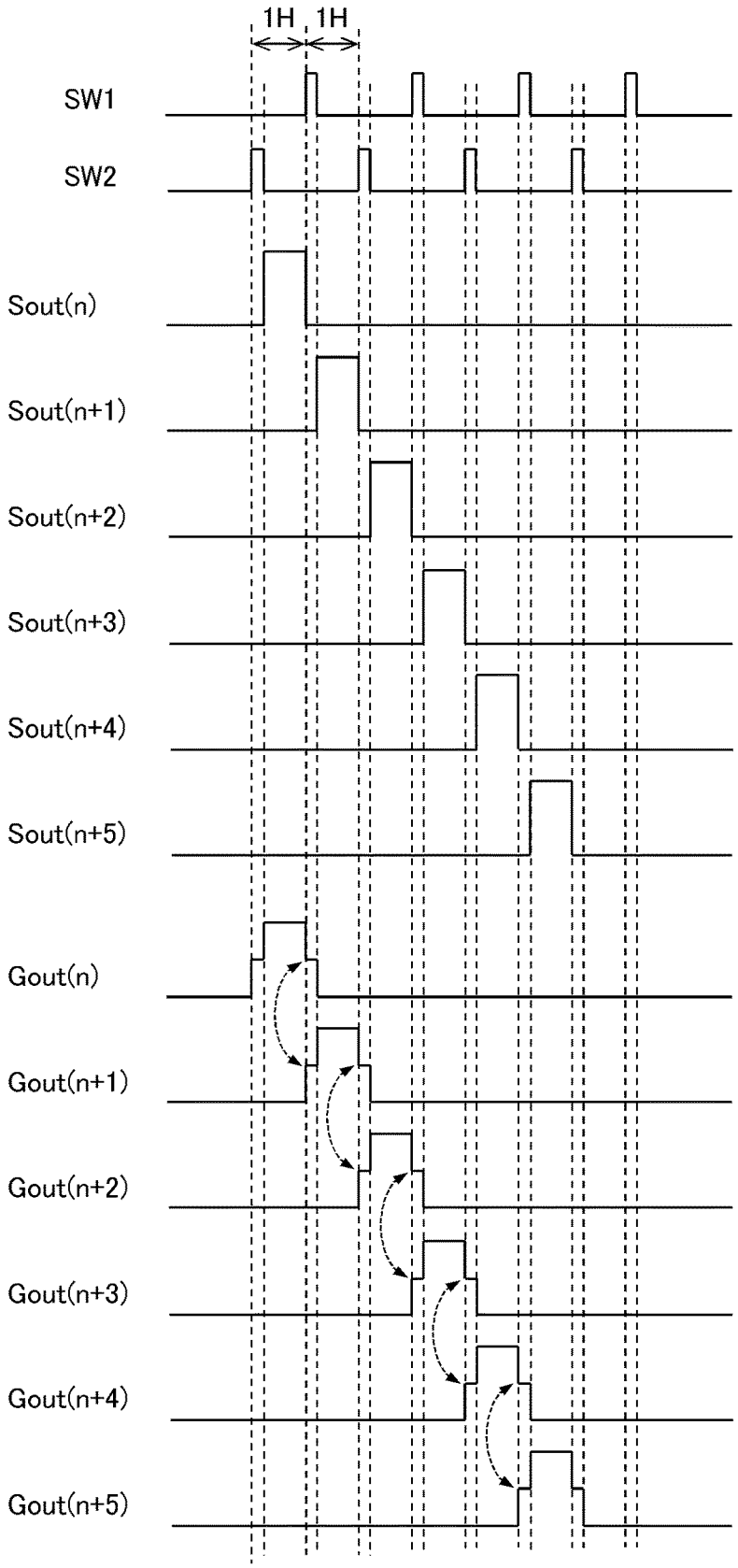
FIG. 8 is a timing chart illustrating output signal, gate signal, and control signal of output circuit of the first configuration example.

FIG. 8 is a timing chart illustrating output signal Sout, gate signal Gout, and control signal SW of output circuit S of the first configuration example. After output signal Sout (n) is switched from the high level to the low level and nth-row gate line 12 becomes a floating state, first control signal SW1 (gate-on voltage) is supplied to the gate electrode of first transistor 32. When first control signal SW1 (gate-on voltage) is supplied to first transistor 32, first transistor 32 becomes an on state, and two adjacent gate lines 12 electrically connected to first transistor 32 are electrically connected to each other (short-circuited) as illustrated in FIG. 7. In other words, the output terminal of output circuit S(n) is electrically connected to the output terminal of output circuit S(n+1). A charge of output signal Sout(n) is distributed to nth-row gate line 12 and (n+1)th-row gate line 12. Consequently, as illustrated in FIG. 8, a potential of gate signal Gout(n) supplied to nth-row gate line 12 is lowered, and a potential of gate signal Gout(n+1) supplied to (n+1)th-row gate line 12 is raised immediately before an (n+1)th-row write period starts.

Then, when output signal Sout(n) is input to (n+1)th-row shift register circuit SR(n+1), shift register circuit SR(n+1) outputs the pulse signal (the low level, the high level) corresponding to clock CK1 as output signal SRout(n+1). While output signal SRout(n+1) is input to shift register circuit SR(n+2) of the subsequent stage, level shifter circuit LS(n+1) and buffer circuit BF(n+1) convert output signal SRout(n+1) into output signal Sout(n+1). Output signal Sout(n+1) is supplied to gate line 12 as gate signal Gout(n+1). Consequently, the potential of gate signal Gout(n+1) supplied to (n+1)th-row gate line 12 is further raised. After output signal Sout(n+1) is then switched from the high level to the low level and (n+1)th-row gate line 12 becomes the floating state, second control signal SW2 is supplied to the gate electrode of second transistor 33. When second control signal SW2 is supplied to second transistor 33, second transistor 33 becomes the on state, and two adjacent gate lines 12 electrically connected to second transistor 33 are electrically connected to each other (short-circuited) as illustrated in FIG. 7. The charge of output signal Sout(n+1) is distributed to (n+1)th-row gate line 12 and (n+2)th-row gate line 12. Consequently, as illustrated in FIG. 8, the potential of gate signal Gout(n+1) supplied to (n+1)th-row gate line 12 is lowered, and the potential of gate signal Gout(n+2) supplied to (n+2)th-row gate line 12 is raised immediately before an (n+2)th-row write period starts.

As described above, gate signal Gout in which the charge is distributed between two adjacent gate lines 12 is sequentially supplied to gate line 12. According to the above configuration, before gate line 12 is charged to a predetermined potential by output signal Sout of output circuit S, gate line 12 can previously be charged (pre-charged) to, for example, a half of the predetermined potential by distributing the potential (charge) of another gate line 12. Consequently, drive power of gate line drive circuit 30 can be reduced (for example, reduced by half). Further, it is only necessary to add the transistor to gate line drive circuit 30, and accordingly, the circuit configuration is not complicated. Thus, the power consumption can be reduced without complication of the circuit configurations of gate line drive circuit 30 and liquid crystal display device 1.

In the above configuration, when nth-row gate line 12 and (n+1)th-row gate line 12 are in the floating state after output circuit S(n) outputs the gate-on voltage to nth-row gate line 12, first transistor 32 is put into the on state to electrically connect nth-row gate line 12 and (n+1)th-row gate line 12. However, the gate line drive circuit 30 of the first configuration example is not limited to this configuration. For example, while output circuit S(n) outputs (is outputting) the gate-on voltage to nth-row gate line 12, first transistor 32 may be put into the on state to electrically connect nth-row gate line 12 and (n+1)th-row gate line 12. In this case, it is preferable that first transistor 32 is put into the on state immediately before a write period for nth-row gate line 12 ends.

Figure 9:
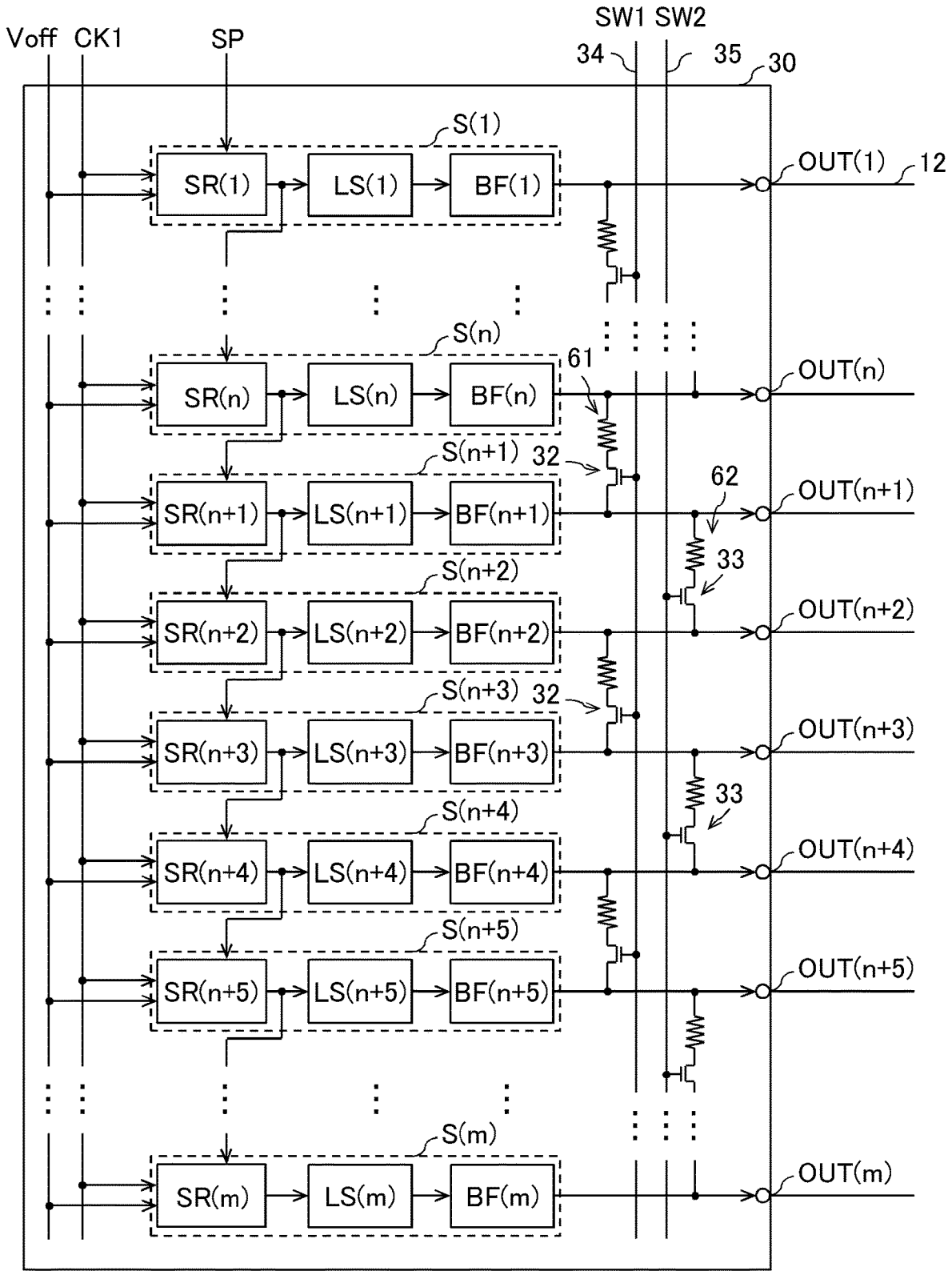
FIG. 9 is a plan view illustrating another configuration of gate line drive circuit of the first configuration example.
Figure 10:
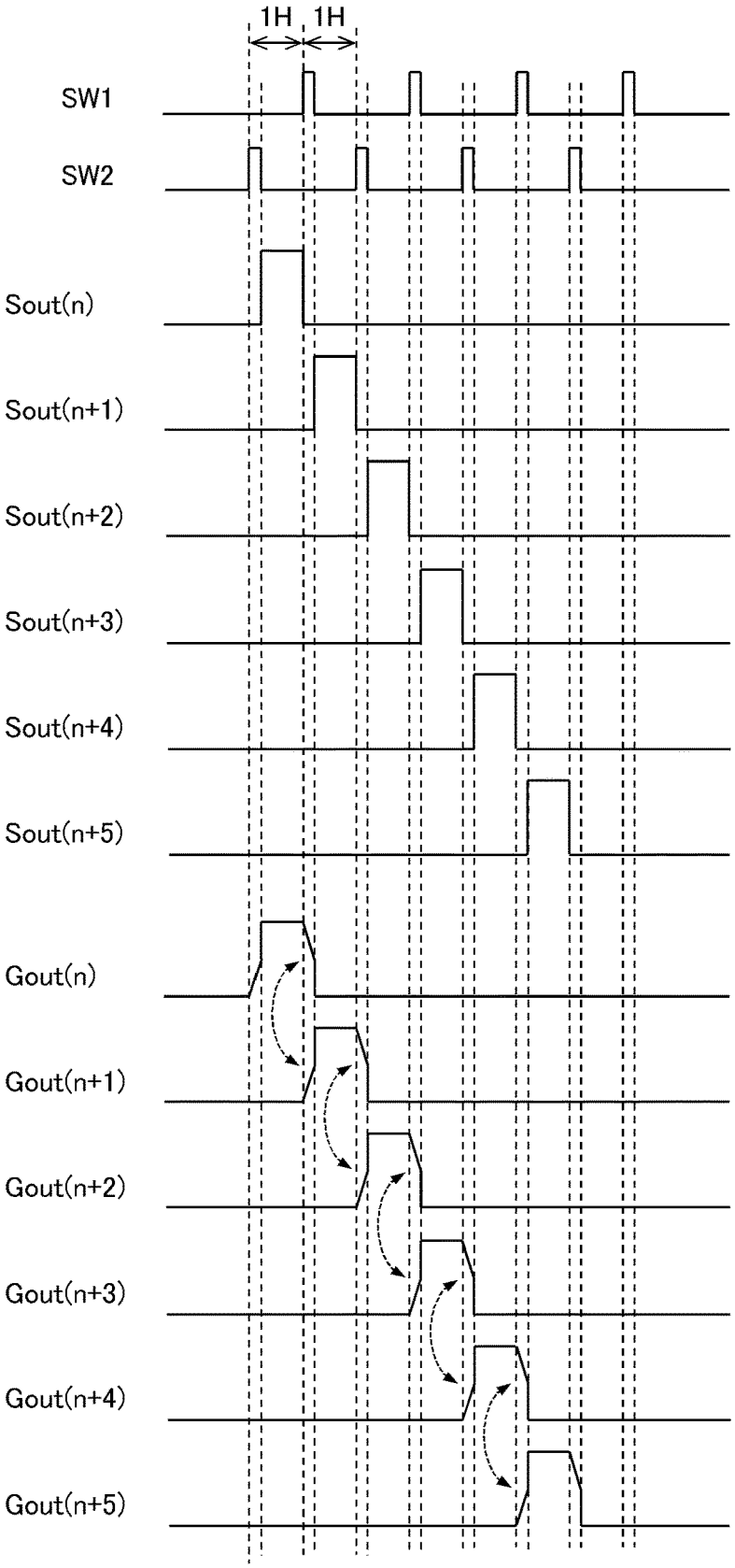
FIG. 10 is a timing chart illustrating output signal, gate signal, and control signal of output circuit of the first configuration example.

Gate line drive circuit 30 of the first configuration example is not limited to the above configuration. FIG. 9 is a plan view illustrating another configuration of gate line drive circuit 30 of the first configuration example. First resistor 61 connected to first transistor 32 and second resistor 62 connected to second transistor 33 are provided in gate line drive circuit 30 of FIG. 9. According to the configuration of FIG. 9, for example, in the case where first transistor 32 between adjacent nth-row gate line 12 and (n+1)th-row gate line 12 becomes the on state and these two gate lines 12 are short-circuited, a time constant between these two gate lines 12 increases, so that the potential of gate signal Gout(n) is gradually lowered while the potential of gate signal Gout(n+1) is gradually raised as illustrated in FIG. 10. Similarly, in the case where second transistor 33 between adjacent (n+1)th-row gate line 12 and (n+2)th-row gate line 12 becomes the on state and these two gate lines 12 are short-circuited, a time constant between these two gate lines 12 increases, so that the potential of gate signal Gout(n+1) is gradually lowered while the potential of gate signal Gout(n+2) is gradually raised as illustrated in FIG. 10. That is, an inclination (slope) is formed in a rising waveform and a falling waveform of gate signal Gout. Consequently, in-plane evenness of the display can be improved.

The configuration for increasing the time constant between two gate lines 12 is not limited to the configuration in FIG. 9. For example, in the configuration of FIG. 6, size (channel width) of channel portions of first transistor 32 and second transistor 33 may be decreased. Consequently, an on-resistance value of each transistor is increased, and the time constant can be increased. In this configuration, the necessity of an additional resistor (see FIG. 9) is eliminated and the transistor is reduced in size, so that a circuit scale of gate line drive circuit 30 can be reduced.

Figure 11:
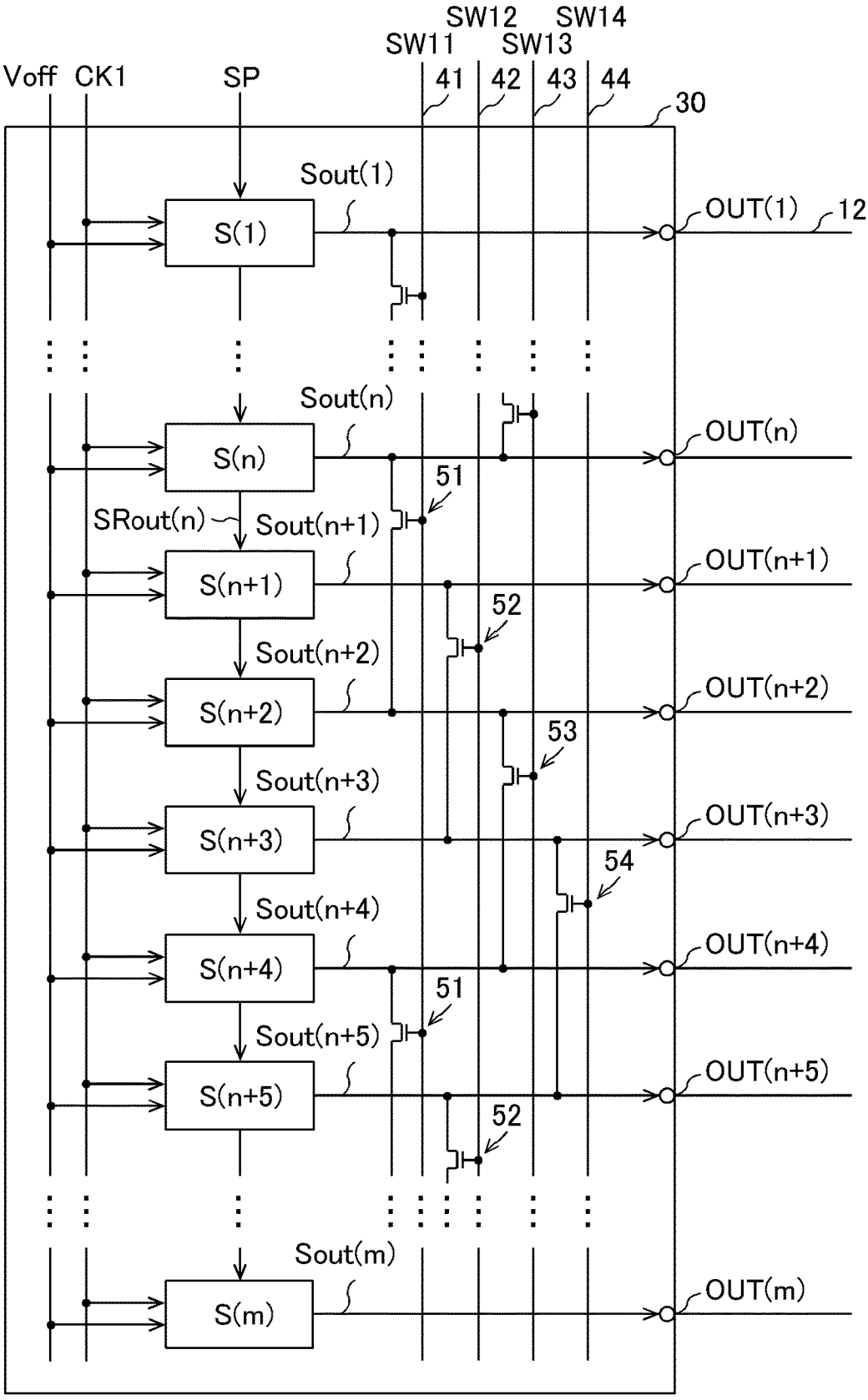
FIG. 11 is a plan view illustrating another configuration of gate line drive circuit of the first configuration example.

FIG. 11 is a plan view illustrating another configuration of gate line drive circuit 30 of the first configuration example. In FIG. 11, for convenience, output circuit S is illustrated, and shift register circuit SR, level shifter circuit LS, and buffer circuit BF of output circuit S are omitted. In gate line drive circuit 30 of FIG. 11, each transistor is provided such that one of conductive electrodes is electrically connected to first gate line 12 while the other conductive electrode is electrically connected to the second gate line disposed in a scanning direction with respect to the first gate line. More specifically, first transistor 51 is electrically connected to nth-row gate line 12 and (n+2)th-row gate line 12, second transistor 52 is electrically connected to (n+1)th-row gate line 12 and (n+3)th-row gate line 12, third transistor 53 is electrically connected to (n+2)th-row gate line 12 and (n+4) th-row gate line 12, and fourth transistor 54 is electrically connected to (n+3)th-row gate line 12 and (n+5)th-row gate line 12. First to fourth transistors 51 to 54 are electrically connected to two gate lines 12 in this order. The gate electrodes of the plurality of first transistors 51 are electrically connected to first control line 41, the gate electrodes of the plurality of second transistors 52 are electrically connected to second control line 42, the gate electrodes of the plurality of third transistors 53 are electrically connected to third control line 43, and the gate electrodes of the plurality of fourth transistors 54 are electrically connected to fourth control line 44.

Figure 12:
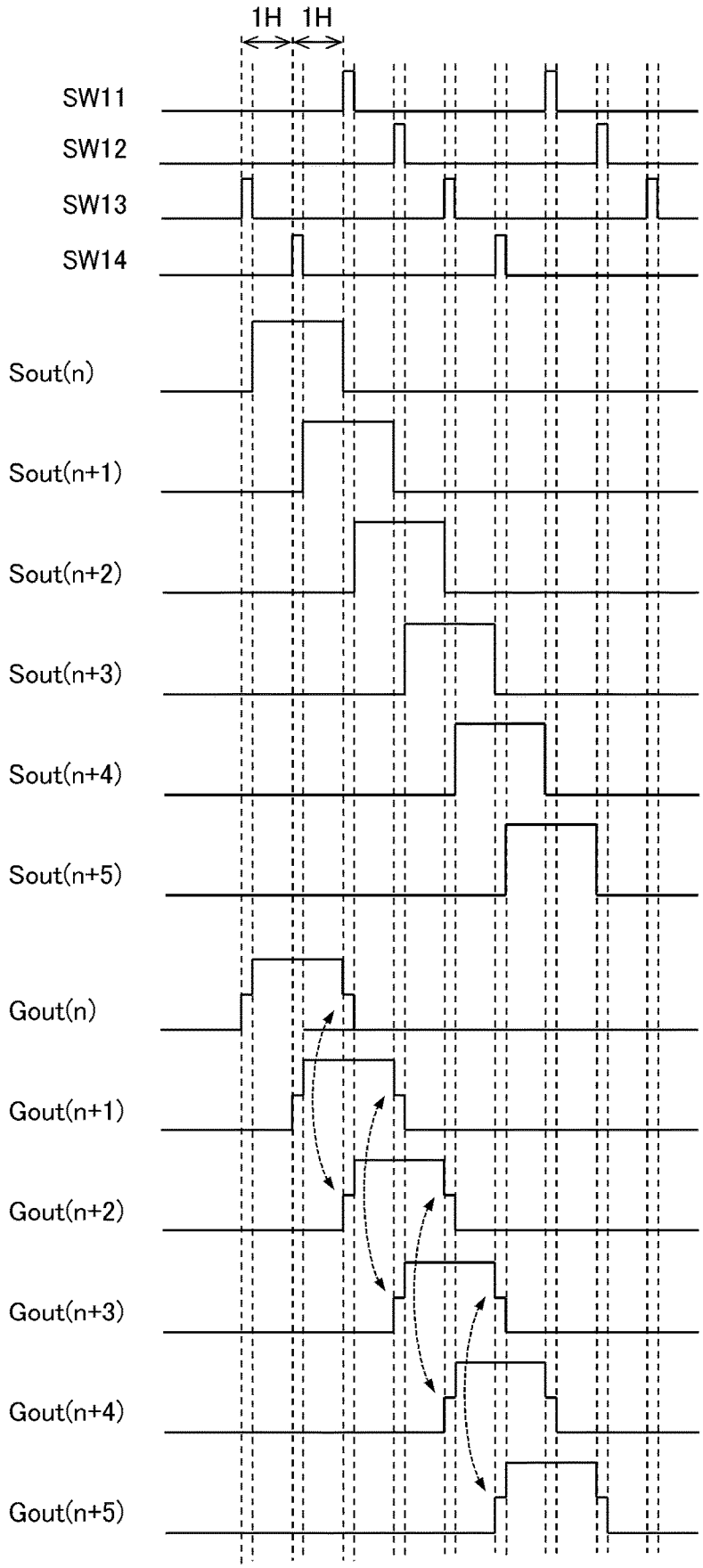
FIG. 12 is a timing chart illustrating output signal, gate signal, and control signal of output circuit of the first configuration example.

FIG. 12 is a timing chart illustrating output signal Sout, gate signal Gout, and control signal SW of output circuit S, which correspond to gate line drive circuit 30 in FIG. 11. In gate line drive circuit 30 of FIG. 11, each output circuit S outputs output signal Sout that becomes the high level in two horizontal scanning periods. Output circuit S(n+1) outputs output signal Sout(n+1) after one horizontal scanning period since output circuit S(n) outputs output signal Sout(n), for example. That is, each output circuit S outputs, to each gate line 12, the gate-on voltage that becomes the high level in the two horizontal scanning periods every time one horizontal scanning period elapses. For this reason, gate line drive circuit 30 in FIG. 11 simultaneously selects two gate lines 12 only in a predetermined period (in this case, one horizontal scanning period). According to this configuration, the gate line 12 can be reliably charged to an objective potential before the data voltage is written, so that the display quality can be improved.

When first control signal SW11 is supplied to the gate electrode of first transistor 51 after output signal Sout(n) is switched from the high level to the low level to put nth-row gate line 12 into the floating state, first transistor 51 becomes the on state, and two gate lines 12 electrically connected to first transistor 51 are electrically connected to each other (short-circuited) as illustrated in FIG. 11. As illustrated in FIG. 12, the charge of output signal Sout(n) is distributed to nth gate line 12 and (n+2)th gate line 12. Consequently, the potential of gate signal Gout(n) supplied to nth gate line 12 is lowered, and the potential of gate signal Gout(n+2) supplied to (n+2)th gate line 12 is raised immediately before an (n+2)th write period starts.

When output signal Sout(n+1) is then input to (n+2)th-row shift register circuit SR(n+2) and high-level output signal Sout(n+2) is output from output circuit S(n+2), the potential of gate signal Gout(n+2) supplied to (n+2)th-row gate line 12 is further raised.

Similarly, gate signal Gout in which the charge is distributed between two gate lines 12 is sequentially supplied to gate line 12. According to the above configuration, similarly to gate line drive circuit 30 in FIG. 6, before gate line 12 is charged to a predetermined potential by output signal Sout, gate line 12 can previously be charged (pre-charged) to, for example, a half of the predetermined potential by distributing the potential of another gate line 12. Consequently, the drive power of gate line drive circuit 30 can be reduced (for example, reduced by half). In gate line drive circuit 30 of FIG. 11, the resistor of FIG. 9 may be added, or the size (channel width) of each channel portion of first to fourth transistors 51 to 54 may be adjusted (for example, narrowed). Because the inclination (slope) is formed in the rising waveform and the falling waveform of gate signal Gout, the in-plane evenness of the display can be improved.

Two gate lines 12 to which the transistor is electrically connected are not limited to nth-row gate line 12 and (n+2)th-row gate line 12, but may be nth-row gate line 12 and (n+α)th-row (α is an integer of 3 or more) gate line 12.

Second Configuration Example

Figure 13:
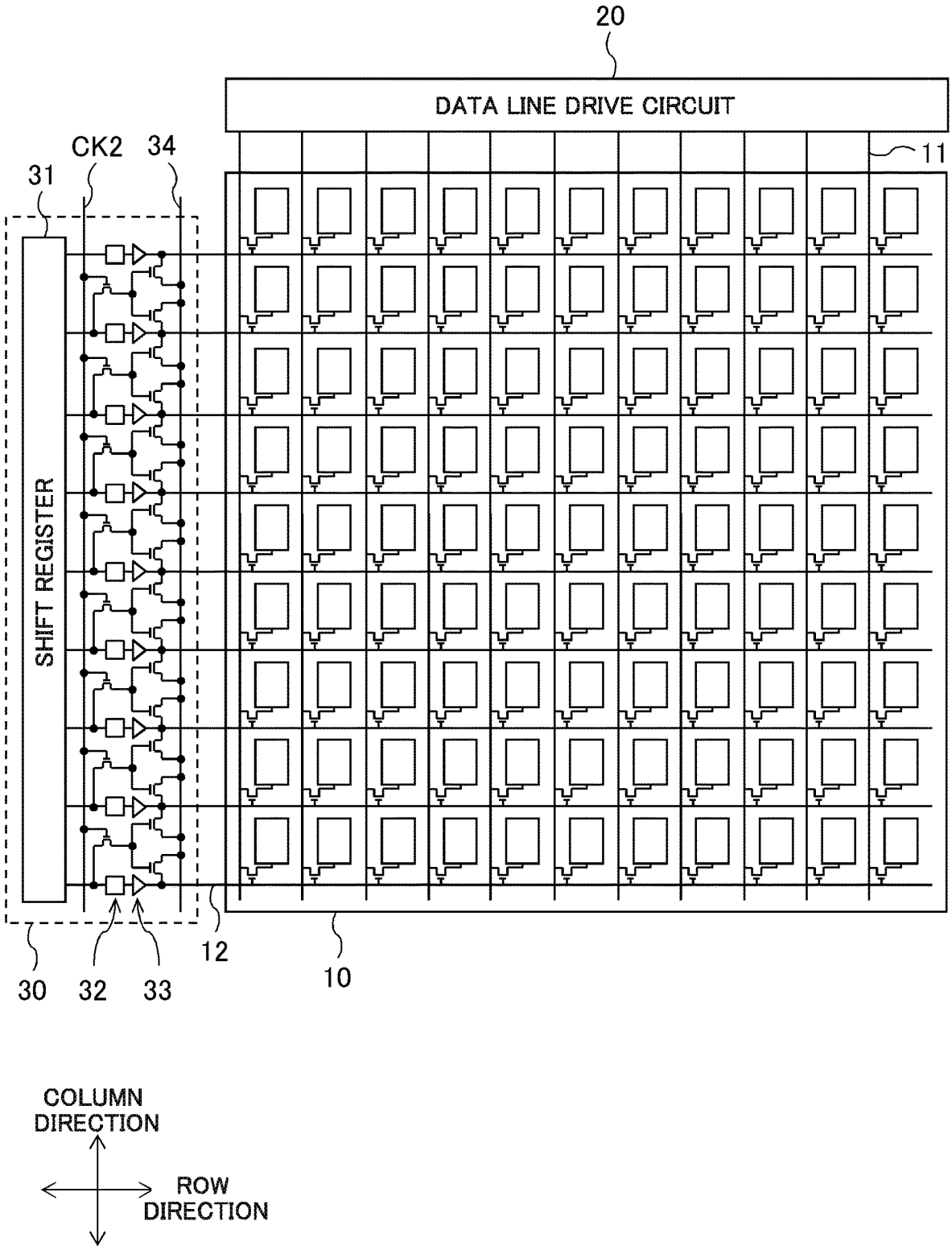
FIG. 13 is a plan view illustrating a schematic configuration of gate line drive circuit of the second configuration example.
Figure 14:
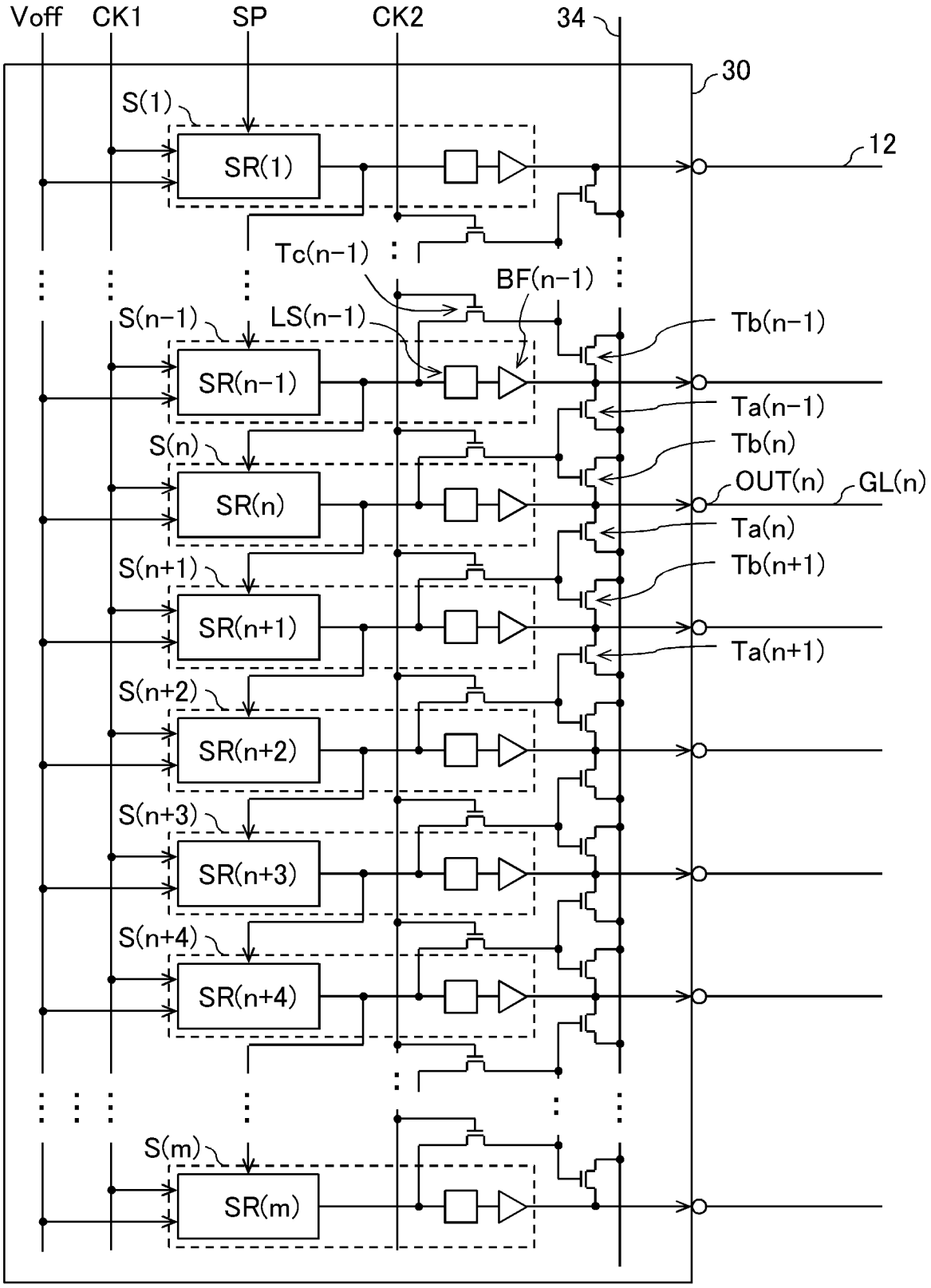
FIG. 14 is a plan view illustrating a specific configuration of gate line drive circuit of the second configuration example.

A specific configuration of gate line drive circuit 30 according to a second configuration example will be described below. FIG. 13 is a plan view illustrating a schematic configuration of gate line drive circuit 30 of the second configuration example. FIG. 14 is a plan view illustrating a specific configuration of gate line drive circuit 30 of the second configuration example. Gate line drive circuit 30 of the second configuration example includes shift register 31 including the plurality of shift register circuits SR, level shifter 32 including the plurality of level shifter circuits LS, output buffer 33 including the plurality of buffer circuits BF, the plurality of first transistors Ta and the plurality of second transistors Tb, which electrically connect two adjacent gate lines 12, first control line 34 that is connected to conductive electrodes of first transistor Ta and second transistor Tb, a plurality of control transistors Tc that control turning on and off of first transistor Ta and second transistor Tb, and a clock line through which a control signal (clock CK2) is supplied to control transistor Tc.

Clock CK1 and gate-off voltage Voff are input to each shift register circuit SR. Start pulse SP is input to first-stage shift register circuit SR(1), and an output signal of preceding-stage shift register circuit SR is input to shift register circuits SR from second and following stages. Each level shifter circuit LS converts a voltage level of the output signal of each shift register circuit SR, and outputs the signal to subsequent each buffer circuit BF. Each buffer circuit BF amplifies the signal converted by each level shifter circuit LS and delays the signal by a predetermined time, to output the gate signal (the gate-on voltage/the gate-off voltage) to each gate line 12. Shift register circuit SR, level shifter circuit LS, and buffer circuit BF of each stage constitute output circuit S of each stage. That is, nth-stage output circuit S(n) includes shift register circuit SR(n), level shifter circuit LS(n), and buffer circuit BF(n), and outputs output signal Sout(n) corresponding to gate signal Gout(n). Buffer circuit BF also acts as a delay circuit.

A specific connection relationship will be described by focusing on nth-row gate line 12 in FIG. 14. Gate line 12 electrically connected to the nth-stage shift register circuit is expressed by gate line GL(n), and each component connected to gate line GL(n) is expressed by adding reference numeral (n). Reference numerals of gate lines 12 electrically connected to first-stage to mth-stage shift register circuits SR(1) to SR(m) and each component are equivalent to the above reference numerals.

The input terminal of level shifter circuit LS(n) and a first conductive electrode (hereinafter, referred to as a drain electrode) of control transistor Tc(n) are connected to the output terminal of shift register circuit SR(n). The input terminal of buffer circuit BF(n) is connected to the output terminal of level shifter circuit LS(n), and the drain electrode of first transistor Ta(n) and the drain electrode of second transistor Tb(n) are connected to the output terminal of buffer circuit BF(n). A second conductive electrode (hereinafter, referred to as a source electrode) of control transistor Tc(n) is connected to a control electrode (hereinafter, referred to as a gate electrode) of second transistor Tb(n) and the gate electrode of first transistor Ta(n−1) connected to gate line GL(n−1) of the preceding stage. Clock line (CK2) is connected to the gate electrode of control transistor Tc(n), and first connection wiring 34 is connected to the source electrodes of first transistor Ta(n), second transistor Tb(n), and second transistor Tb(n−1). The drain electrode of first transistor Ta(n) and the drain electrode of second transistor Tb(n) are connected to output terminal OUT(n), and gate line GL(n) is electrically connected to output terminal OUT(n). The output terminal of output circuit S(n) is connected to output terminal OUT(n), and the output signal of output circuit S(n) is connected to gate line GL(n). The similar configuration is provided corresponding to each gate line 12.

In the above configuration, the gate electrodes of control transistors Tc(1) to Tc(m) are connected to one clock line (CK2), and the source electrodes of each first transistor Ta and each second transistor Tb are connected to one first connection wiring 34. In one gate line 12, first transistor Ta is disposed on the subsequent stage side, and second transistor Tb is disposed on the preceding stage side. First transistor Ta(n−1) connected to gate line GL(n−1) and second transistor Tb(n) connected to gate line GL(n) are disposed between two adjacent gate lines GL(n−1), GL(n), and these gate lines GL(n−1), GL(n) are electrically connected to each other through first transistor Ta(n−1) and second transistor Tb(n). The output signals of output circuits S(1) to S(m) are subjected to the processing (charge distribution processing) according to the operation to turn on and off control transistor Tc using control signal (clock CK2), and are sequentially output as gate signals Gout(1) to Gout(m) from output terminals OUT(1) to OUT(m) to gate lines GL(1) to GL(m) of first to mth rows.

Figure 15:
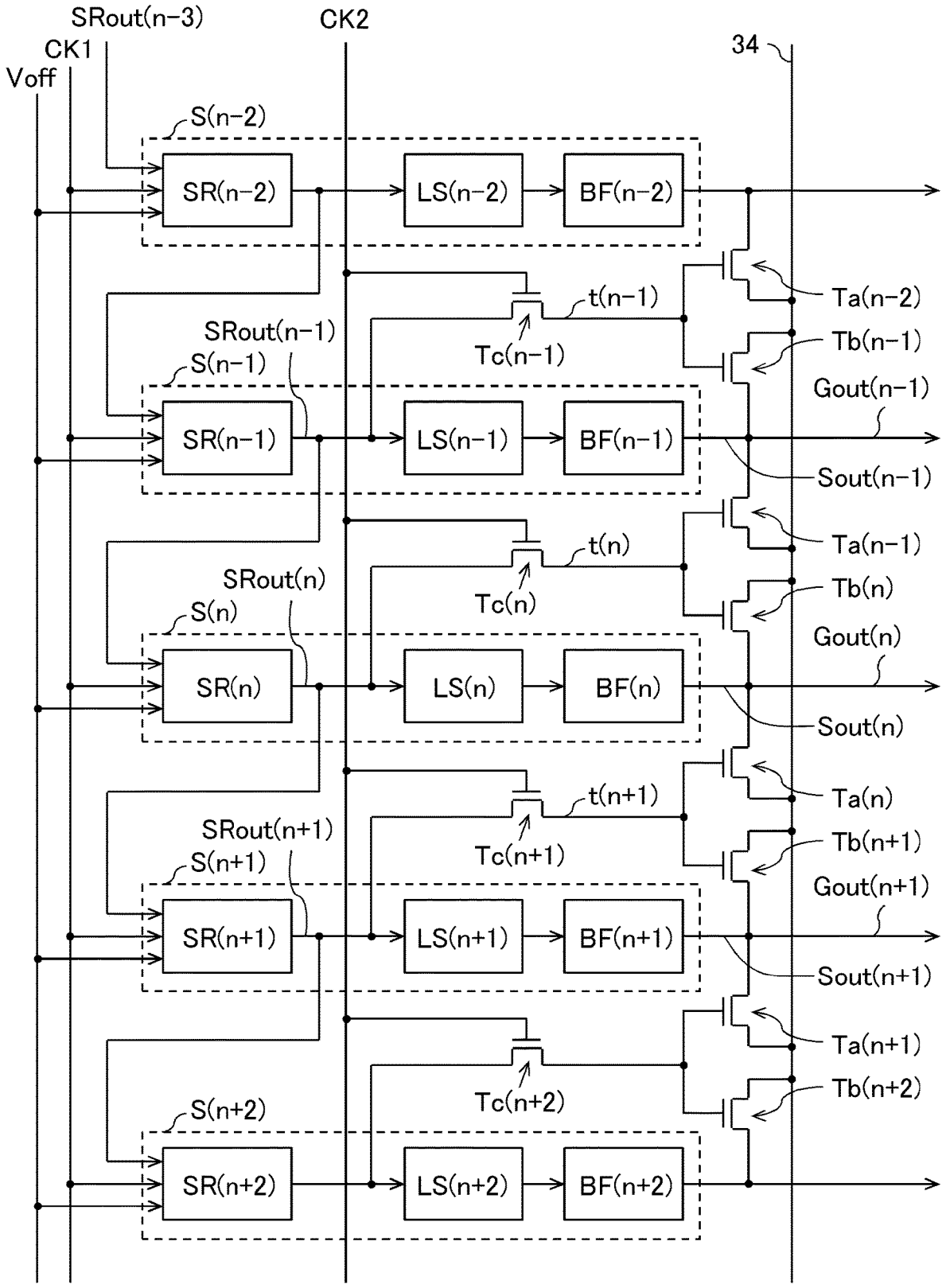
FIG. 15 is a view illustrating a configuration example of output circuit of the second configuration example.
Figure 16:
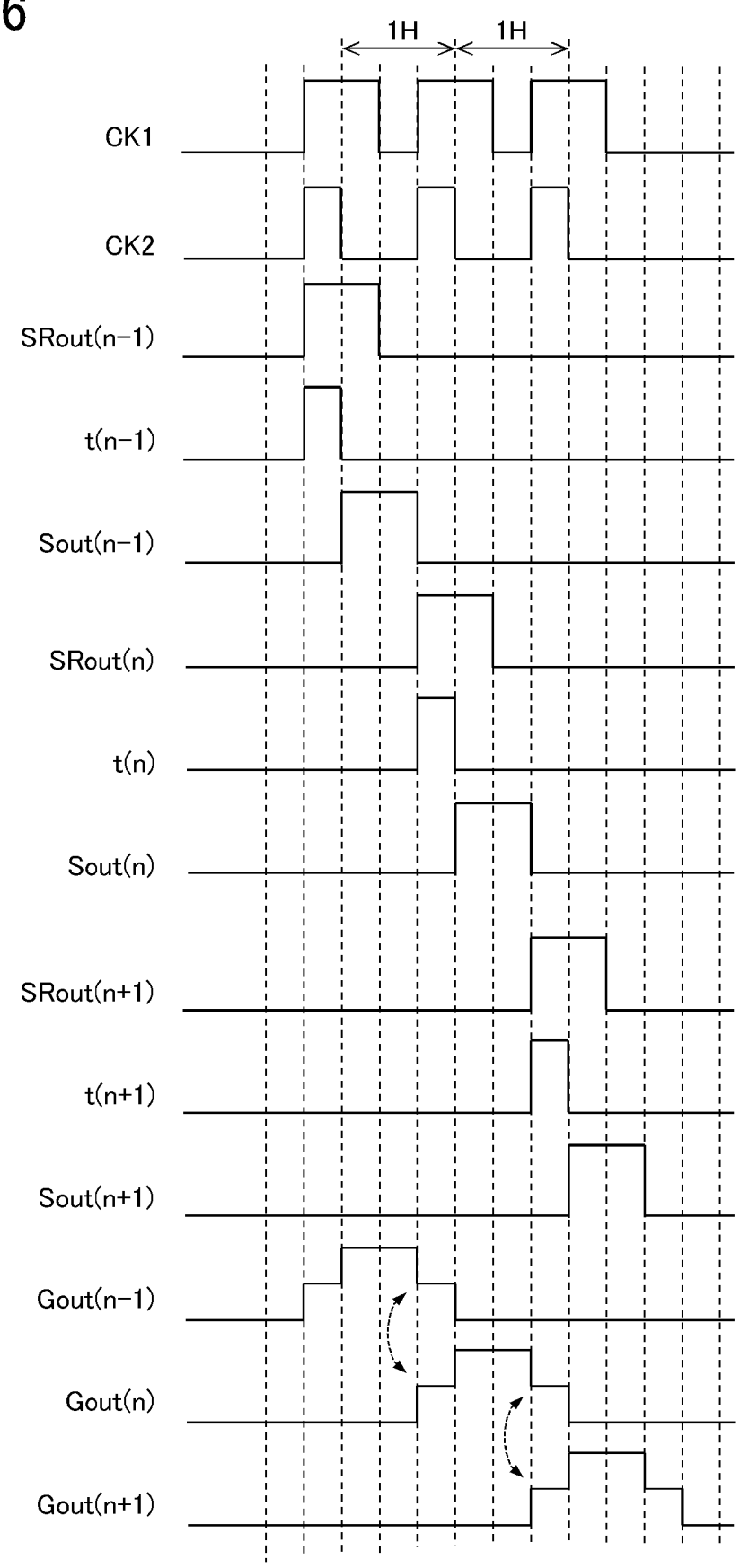
FIG. 16 is a timing chart illustrating output signal, gate signal, and control signal of output circuit of the second configuration example.

Next, the specific operation of gate line drive circuit 30 of the second configuration example will be described below. FIG. 15 is a view illustrating a configuration example of output circuit S of the second configuration example. Output circuit S will be described by exemplifying (n−1)th-stage output circuit S(n−1), nth-stage output circuit S(n), and (n+1)th-stage output circuit S(n+1) in FIG. 15. FIG. 16 is a timing chart illustrating the operation of gate line drive circuit 30 of the second configuration example.

A known configuration can be adopted to each shift register circuit SR, each level shifter circuit LS, and each buffer circuit BF. A clock line is connected to a clock terminal of shift register circuit SR, and clock CK1 is input to the clock terminal. An off-signal line is connected to a reset terminal of shift register circuit SR, and gate-off voltage Voff (reset signal) is input to the reset terminal in order to turn off thin film transistor 13.

Output signal SRout(n−1) output from shift register circuit SR(n−1) of a preceding stage is input to an input terminal of shift register circuit SR(n). When output signal SRout(n−1) is input to the input terminal while clock CK1 is input to the clock terminal, shift register circuit SR(n) outputs a pulse signal (a low level, a high level) corresponding to clock CK1 as output signal SRout(n). While output signal SRout(n) is input to shift register circuit SR(n+1) of the subsequent stage, level shifter circuit LS(n) and buffer circuit BF(n) convert output signal SRout(n) into output signal Sout(n). Output signal Sout(n) is supplied to gate line GL(n) as gate signal Gout(n). Output signal Sout(n) is a signal delayed by a predetermined time with respect to output signal SRout(n). Output signal SRout(n) of shift register circuit SR(n) is input to the drain electrode of control transistor Tc(n−1), and is output from the source electrode only in the high-level period of clock CK2. Output signal output through control transistor Tc(n) is expressed as t(n).

When output signal t(n) is supplied to the gate electrodes of first transistor Ta(n−1) and second transistor Tb(n), first transistor Ta(n−1) and second transistor Tb(n) become the on state, and two adjacent gate lines GL(n−1) and GL(n) are electrically connected to each other through first connection wiring 34. In other words, the output terminal of output circuit S(n−1) is electrically connected to the output terminal of output circuit S(n). The charge of output signal Sout(n−1) is distributed to gate line GL(n−1) and gate line GL(n). Consequently, as illustrated in FIG. 16, the potential of gate signal Gout(n−1) supplied to gate line GL(n−1) is lowered, and the potential of gate signal Gout(n) supplied to gate line GL(n) is raised immediately before an nth write period starts.

Then, output signal Sout(n) in which output signal SRout (n) of shift register circuit SR(n) is delayed through level shifter circuit LS(n) and buffer circuit BF(n) is supplied to gate line GL(n) as gate signal Gout(n). Consequently, the potential of gate signal Gout(n) supplied to gate line GL(n) is further raised. Then, output signal Sout(n) is switched from the high level to the low level, and gate line GL(n) becomes the floating state. Thereafter, clock CK2 (high level) is supplied to the gate electrode of control transistor Tc(n+1). Clock CK1 (high level) is supplied to the gate electrodes of first transistor Ta(n) and second transistor Tb(n+1) through control transistor Tc(n+1), first transistor Ta(n) and second transistor Tb(n+1) become the on state, and two adjacent gate lines GL(n) and GL(n+1) are electrically connected to each other (short-circuited). The charge of output signal Sout(n) is distributed to gate line GL(n) and gate line GL(n+1). Consequently, as illustrated in FIG. 16, the potential of gate signal Gout(n) supplied to gate line GL(n) is lowered, and the potential of gate signal Gout(n+1) supplied to gate line GL(n+1) is raised immediately before an (n+1)th write period starts.

As described above, gate signal Gout in which the charge is distributed between two adjacent gate lines 12 is sequentially supplied to gate line 12. According to the above configuration, before gate line 12 is charged to a predetermined potential by output signal Sout of output circuit S, gate line 12 can previously be charged (pre-charged) to, for example, a half of the predetermined potential by distributing the potential (charge) of the preceding-stage gate line 12. Consequently, the drive power of gate line drive circuit 30 can be reduced (for example, reduced by half). Further, it is only necessary to add the transistor to gate line drive circuit 30, and accordingly, the circuit configuration is not complicated. Thus, the power consumption can be reduced without complication of the circuit configurations of gate line drive circuit 30 and liquid crystal display device 1.

In the above configuration, when gate lines GL(n−1) and GL(n) are in the floating state after output circuit S(n−1) outputs the gate-on voltage to gate line GL(n−1), first transistor Ta(n−1) and second transistor Tb(n) are put into the on state through control transistor Tc(n) to electrically connect gate lines GL(n−1) and GL(n). However, the gate line drive circuit 30 of the second configuration example is not limited to the above configuration. For example, while output circuit S(n−1) outputs (is outputting) the gate-on voltage to gate line GL(n−1), first transistor Ta(n−1) and second transistor Tb(n) may be put into the on state through control transistor Tc(n) to electrically connect gate lines GL(n−1) and GL(n). In this case, it is preferable that first transistor Ta(n−1) and second transistor Tb(n) are put into the on state through control transistor Tc(n) immediately before the write period for gate line GL(n−1) ends.

Figure 17:
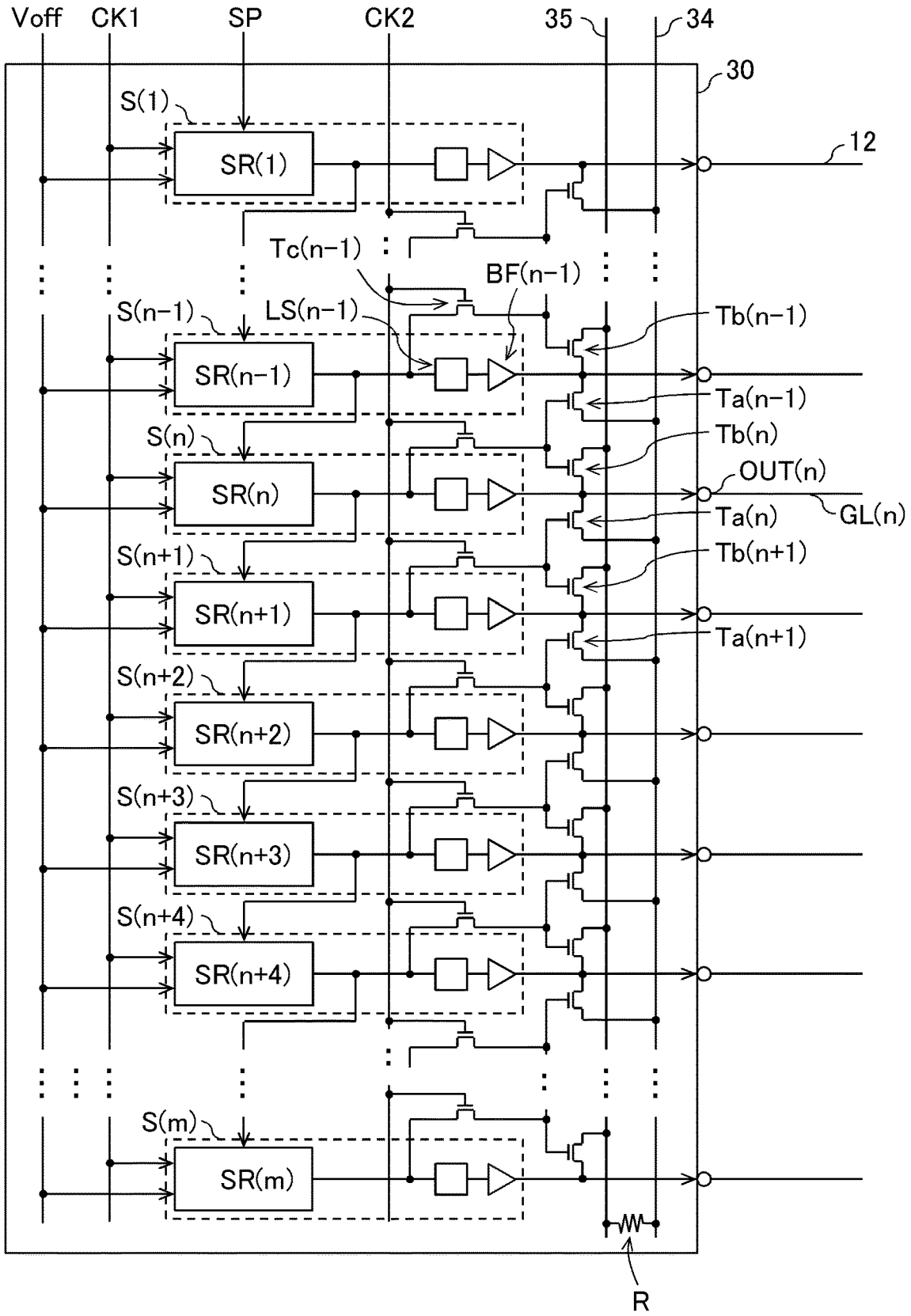
FIG. 17 is a plan view illustrating another configuration of gate line drive circuit of the second configuration example.
Figure 18:
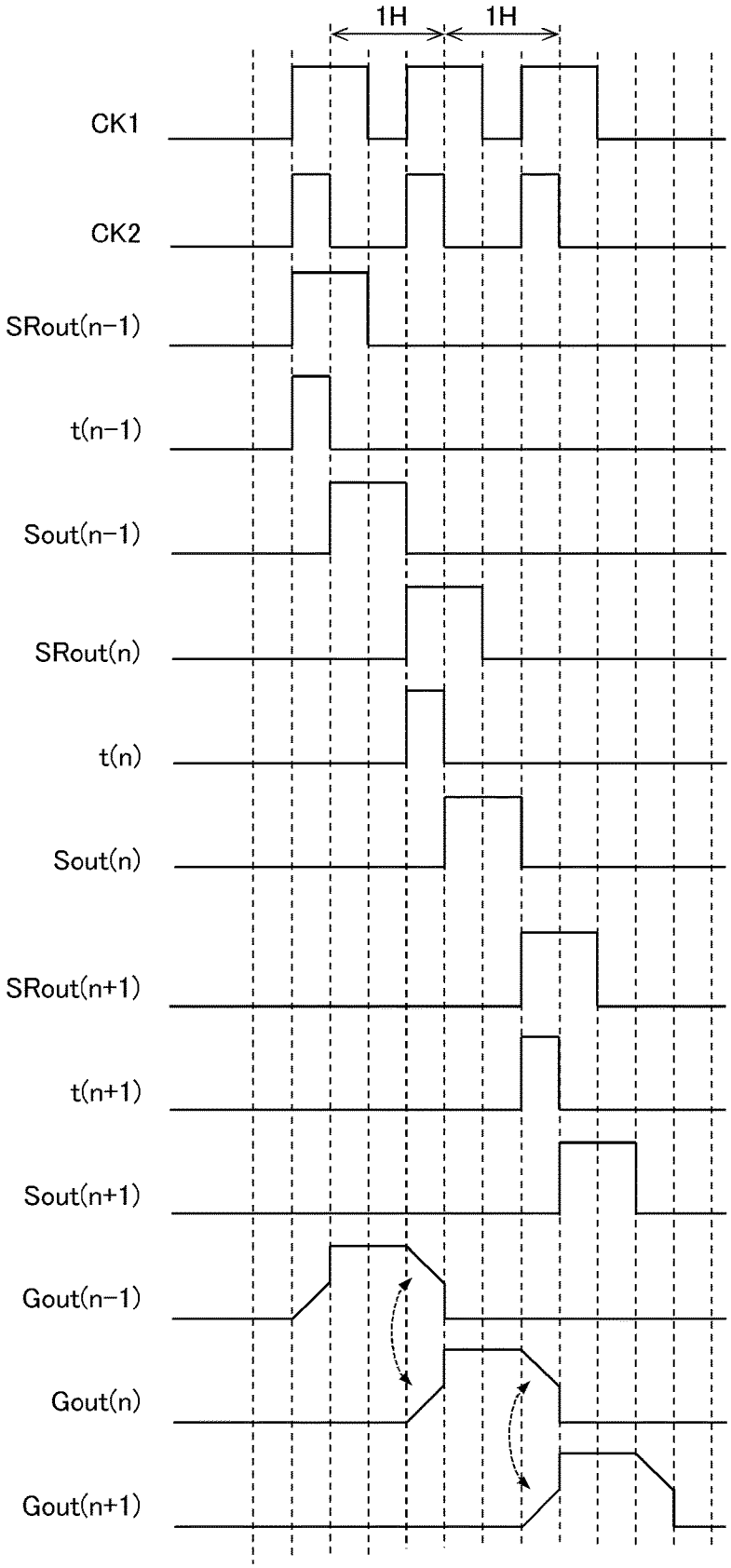
FIG. 18 is a timing chart illustrating output signal, gate signal, and control signal of output circuit of the second configuration example.

Gate line drive circuit 30 of the second configuration example is not limited to the above configuration. FIG. 17 is a plan view illustrating another configuration of gate line drive circuit 30 of the second configuration example. In gate line drive circuit 30 of FIG. 17, a second connection wiring and resistor R are further provided to gate line drive circuit 30 of FIG. 14. As illustrated in FIG. 17, the source electrode of each first transistor Ta is connected to first connection wiring 34, and the source electrode of each second transistor Tb is connected to second connection wiring 35. A first terminal of resistor R is connected to first connection wiring 34, and a second terminal of resistor R is connected to second connection wiring 35. That is, first connection wiring 34 and second connection wiring 35 are electrically connected to each other through resistor R. According to the configuration in FIG. 17, for example, in the case where two adjacent gate lines GL(n−1) and GL(n) are short-circuited, the time constant between gate line GL(n−1) and gate line GL(n) increases, so that the potential of gate signal Gout (n−1) is gradually lowered while the potential of gate signal Gout(n) is gradually raised as illustrated in FIG. 18. Similarly, the potential of gate signal Gout(n) is gradually lowered while the potential of gate signal Gout(n+1) is gradually raised. That is, an inclination (slope) is formed in a rising waveform and a falling waveform of gate signal Gout. Consequently, in-plane evenness of the display can be improved. An inclination angle of the slope can be set by adjusting a resistance value of resistor R.

Figure 19:
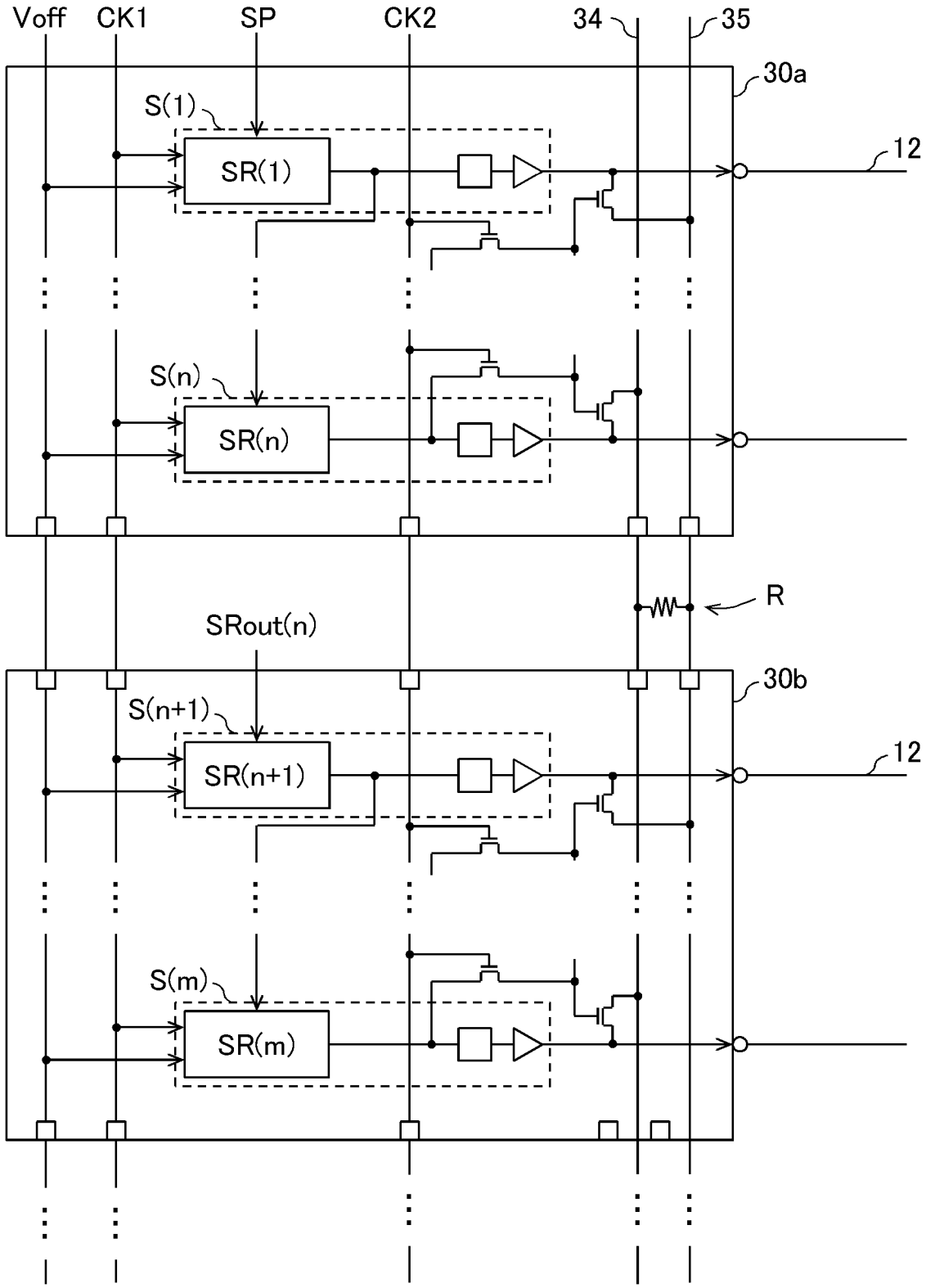
FIG. 19 is a plan view illustrating another configuration of gate line drive circuit of the second configuration example.

FIG. 19 illustrates a modification of FIG. 17. In FIG. 19, gate line drive circuit 30 is constructed with a plurality of gate driver ICs 30*a*, 30*b*, . . . , and resistor R is disposed between adjacent gate driver ICs. Resistor R can be disposed on the substrate constituting the display panel. Thus, it is not necessary to dispose resistor R in gate driver IC, so that the versatility of gate driver IC can be enhanced and downsizing can be achieved. In the configuration of FIG. 19, the resistance value can be set for each display panel, and the gate signal having an optimum slope shape can be output.

Figure 20:
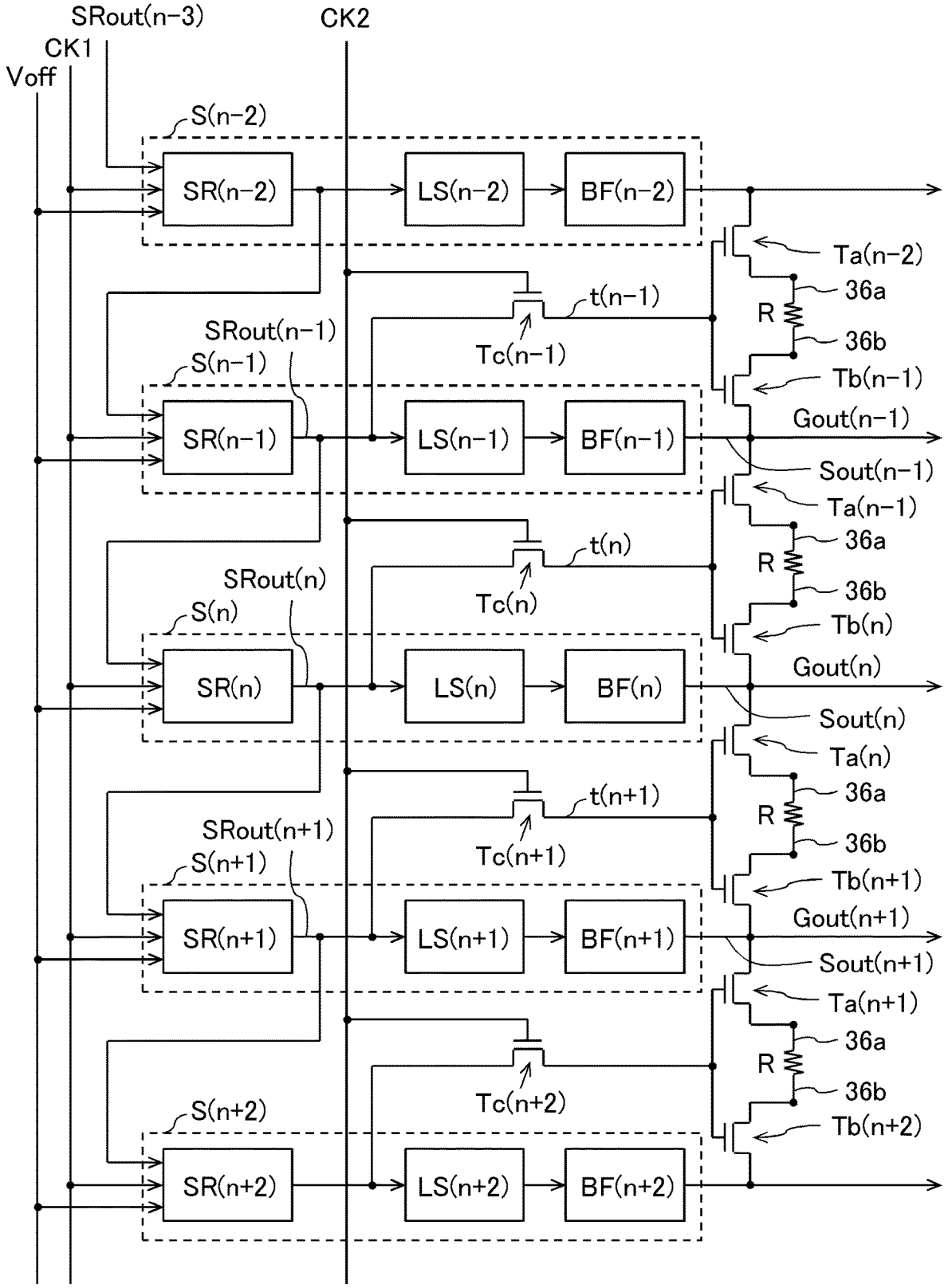
FIG. 20 is a plan view illustrating another configuration of gate line drive circuit of the second configuration example.

FIG. 20 illustrates another modification of FIG. 17. Gate line drive circuit 30 of FIG. 20 includes a plurality of first connection wirings 36*a* and a plurality of second connection wirings 36*b*, and first connection wiring 36*a*, resistor R, and second connection wiring 36*b* are disposed between the source electrode of each first transistor Ta and the source electrode of each second transistor Tb. Specifically, as illustrated in FIG. 20, the source electrode of each first transistor Ta is connected to one end of each first connection wiring 36*a*, and the source electrode of each second transistor Tb is connected to one end of each second connection wiring 36*b*. Further, the first terminal of resistor R is connected to the other end of first connection wiring 36*a*, and the second terminal of resistor R is connected to the other end of second connection wiring 36*b*. First connection wiring 36*a* and second connection wiring 36*b* are electrically connected to each other through resistor R. According to the configuration of FIG. 20, when output signal t(n) is supplied to the gate electrodes of first transistor Ta(n−1) and second transistor Tb(n), for example, first transistor Ta(n−1) and second transistor Tb(n) become the on state, and two adjacent gate lines GL(n−1) and GL(n) are electrically connected to each other through first connection wiring 36*a*, resistor R, and second connection wiring 36*b*. In the case where adjacent gate lines GL(n−1) and GL(n) are short-circuited, because resistor R is interposed between gate line GL(n−1) and gate line GL(n), the inclination (slope) is formed in the rising waveform and falling waveform of gate signal Gout as illustrated in FIG. 18. Consequently, in-plane evenness of the display can be improved. The inclination angle of the slope can be set by adjusting the resistance value of each resistor R.

In each configuration of the second configuration example, the turn-on and-off of first transistor Ta and second transistor Tb are controlled by control transistor Tc. However, the exemplary embodiment is not limited to this configuration. For example, the turn-on and-off of first transistor Ta and second transistor Tb may be controlled by different transistors or different control lines.

Figure 21:
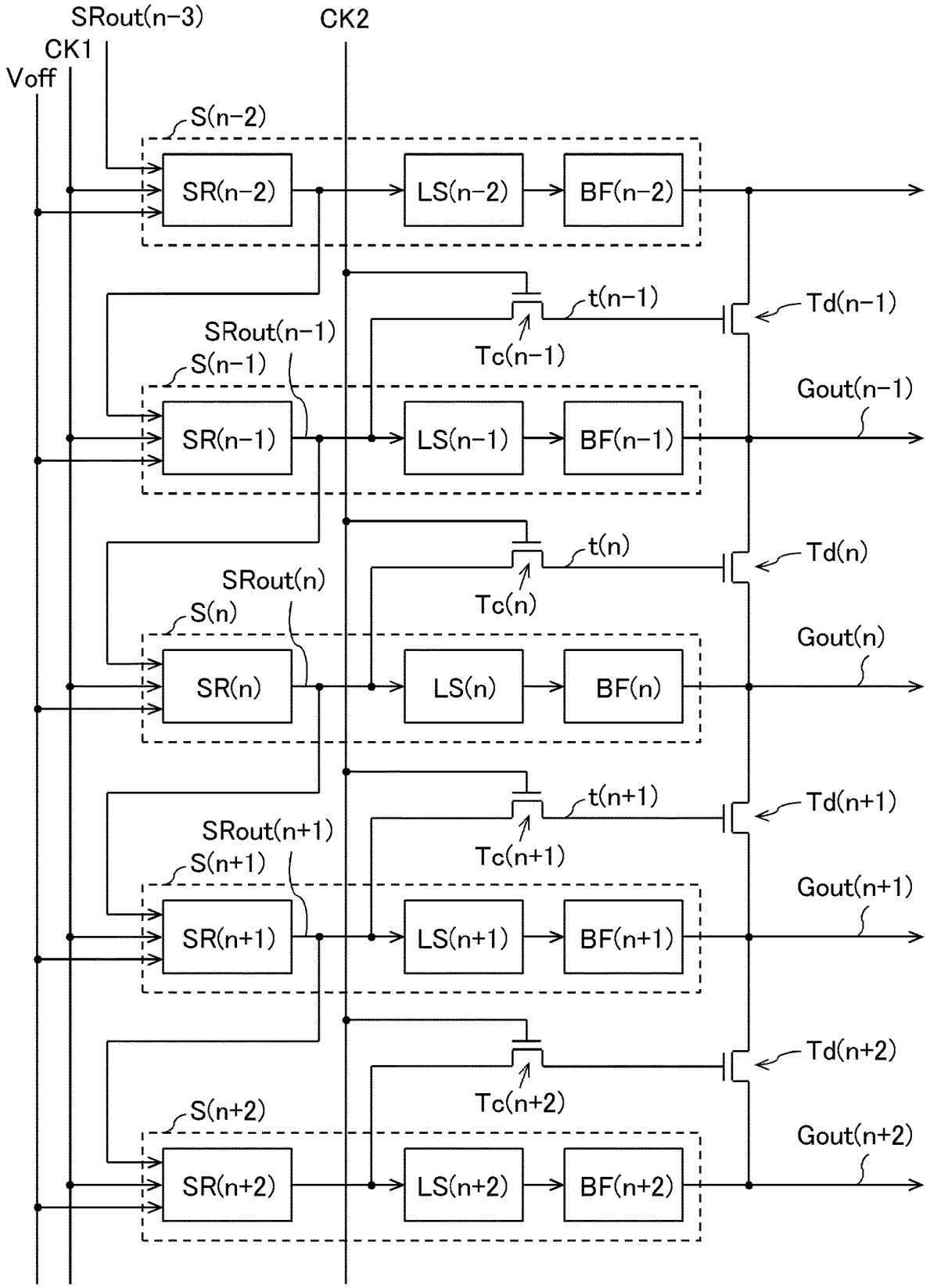
FIG. 21 is a plan view illustrating another configuration of gate line drive circuit of the second configuration example.

FIG. 21 is a plan view illustrating a specific configuration of gate line drive circuit 30 according to another modification of the second configuration example. In gate line drive circuit 30 of FIG. 21, one of two transistors Ta, Tb that electrically connect two adjacent gate lines 12 and first connection wiring 34 connected to the two transistors are eliminated compared with the configuration of FIG. 15. Specifically, in gate line drive circuit 30 of FIG. 21, the gate electrode of transistor Td(n) disposed between adjacent gate lines GL(n−1) and GL(n) is connected to the source electrode of control transistor Tc(n), the drain electrode of transistor Td(n) is connected to gate line GL(n−1), and the source electrode of transistor Td(n) is connected to gate line GL(n). In the above configuration, for example, control signal (clock CK2) is supplied to the control line to put control transistor Tc(n) into the on state after output circuit S(n−1) outputs the gate-on voltage to gate line GL(n−1), whereby transistor Td(n) is put into the on state to electrically connect gate line GL(n−1) and gate line GL(n). The same effect as the configuration of FIG. 15 can be obtained in the above configuration.

Figure 22:
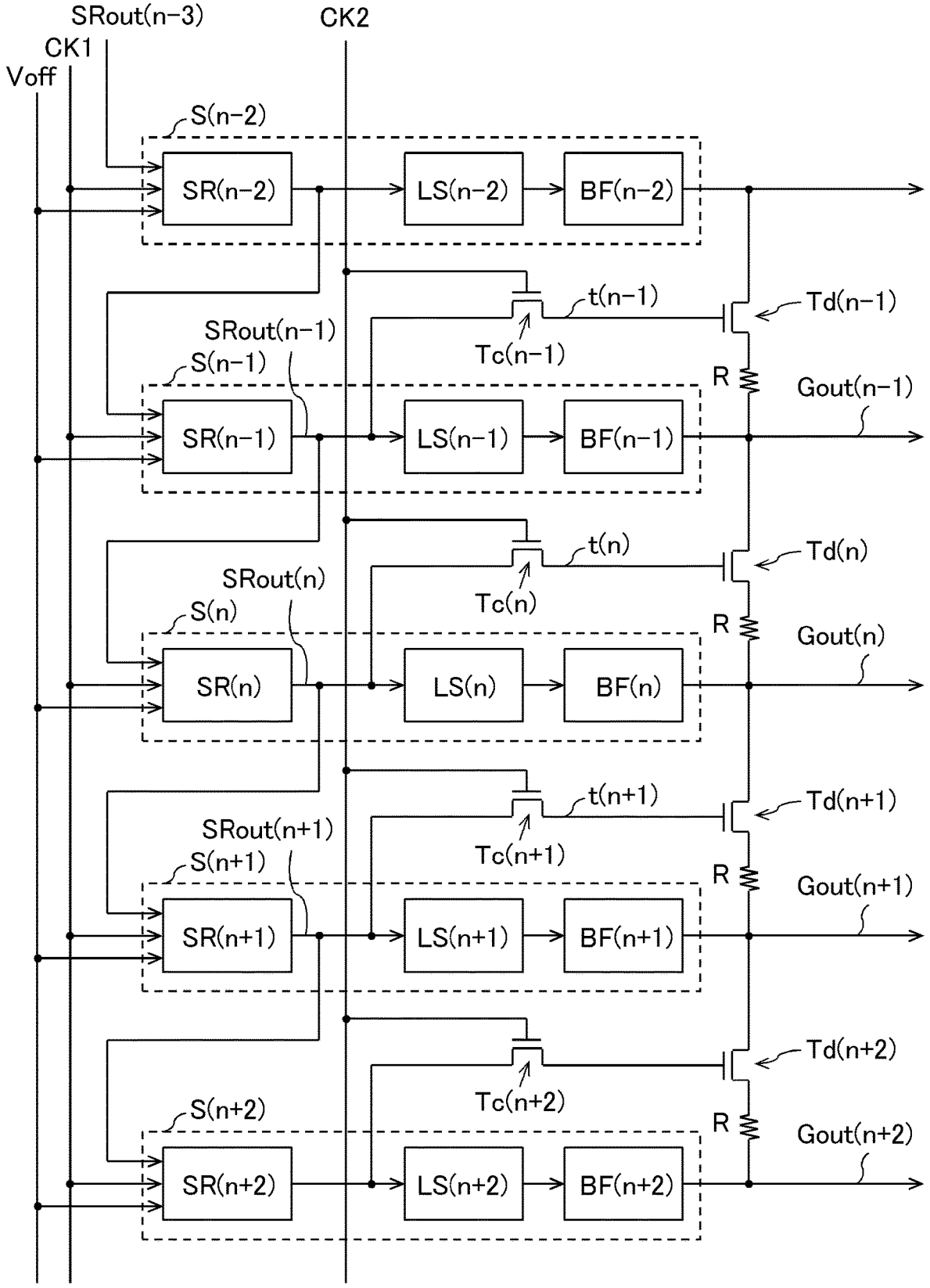
FIG. 22 is a plan view illustrating another configuration of gate line drive circuit of the second configuration example.

In the configuration of FIG. 21, resistor R may be provided between transistor Td(n) and gate line GL(n) as illustrated in FIG. 22. The same effect as the configuration of FIG. 20 can be obtained in the configuration of FIG. 22.

While there have been described what are at present considered to be certain embodiments of the application, it will be understood that various modifications may be made thereto, and it is intended that the appended claims cover all such modifications as fall within the true spirit and scope of the invention.

What is claimed is:

1. A drive circuit comprising:

a first output circuit that outputs a gate-on voltage and a gate-off voltage to a first gate line;

a second output circuit that outputs the gate-on voltage and the gate-off voltage to a second gate line disposed in a scanning direction with respect to the first gate line;

a first transistor in which one of conductive electrodes is electrically connected to the first gate line;

a second transistor in which one of conductive electrodes is electrically connected to the second gate line;

a connection wiring in which another conductive electrode of the first transistor and another conductive electrode of the second transistor are electrically connected to each other, wherein the first transistor and the second transistor are put into an on state to electrically connect the first gate line and the second gate line through the connection wiring after the first output circuit outputs the gate-on voltage to the first gate line; and a control transistor in which one of conductive electrodes is connected to the second output circuit while another conductive electrode is connected to a control electrode of the first transistor and a control electrode of the second transistor, the control electrodes being connected to a control line through which a control signal is supplied, wherein after the first output circuit outputs the gate-on voltage to the first gate line, the control signal is supplied to the control line and the control transistor is put into an on state to put the first transistor and the second transistor into the on state so as to electrically connect the first gate line and the second gate line through the connection wiring.

2. The drive circuit according to claim 1, wherein the first transistor and the second transistor are disposed between the first gate line and the second gate line, the first gate line and the second gate line being adjacent to each other in the scanning direction, and the first gate line and the second gate line are electrically connected to each other through the connection wiring when the first transistor and the second transistor are in the on state.

3. The drive circuit according to claim 1, wherein the control transistor is put into the on state to electrically connect the first gate line and the second gate line through the connection wiring when the first output circuit outputs the gate-on voltage to the first gate line.

4. The drive circuit according to claim 1, wherein the control transistor is put into the on state to electrically connect the first gate line and the second gate line through the connection wiring before the second output circuit outputs the gate-on voltage to the second gate line.

5. The drive circuit according to claim 1, wherein the control transistor is put into the on state to electrically connect the first gate line and the second gate line through the connection wiring when the first gate line and the second gate line are in a floating state.

6. The drive circuit according to claim 1, wherein the control transistor is put into the on state to distribute part of a charge charged in the first gate line to the second gate line.

7. The drive circuit according to claim 1, wherein each output circuit includes a shift register circuit and a delay circuit disposed at a subsequent stage of the shift register circuit, and an output terminal of the shift register circuit is electrically connected to the one of conductive electrodes of the control transistor and the delay circuit.

8. The drive circuit according to claim 1, wherein the connection wiring is in a floating state when the control transistor is in an off state.

9. The drive circuit according to claim 1, wherein the connection wiring includes a first connection wiring and a second connection wiring, the other conductive electrode of the first transistor is electrically connected to the first connection wiring, the other conductive electrode of the second transistor is electrically connected to the second connection wiring, and the first connection wiring and the second connection wiring are electrically connected to each other through a resistor.

10. The drive circuit according to claim 9, wherein the other conductive electrodes of a plurality of the first transistors are connected to the one first connection wiring, the other conductive electrodes of a plurality of the second transistors are connected to the one second connection wiring, and the resistor is disposed between the first connection wiring and the second connection wiring.

11. The drive circuit according to claim 9, wherein a resistance value of the resistor is adjusted such that an inclination is formed in a signal waveform of the gate-on voltage.

12. A display device comprising:

a display panel provided with a plurality of gate lines; and the drive circuit according to claim 1.

13. A display device comprising:

a display panel provided with a plurality of gate lines; and the drive circuit according to claim 9, wherein the drive circuit and the resistor are separately disposed on a substrate constituting the display panel.

14. A drive circuit comprising:

a first output circuit that outputs a gate-on voltage and a gate-off voltage to a first gate line;

a second output circuit that outputs the gate-on voltage and the gate-off voltage to a second gate line disposed in a scanning direction with respect to the first gate line;

a first transistor in which one of conductive electrodes is electrically connected to the first gate line while another conductive electrode is electrically connected to the second gate line; and a second transistor in which one of conductive electrodes is electrically connected to the second output circuit while another conductive electrode is electrically connected to a control electrode of the first transistor, the control electrode being connected to a control line through which a control signal is supplied, wherein after the first output circuit outputs the gate-on voltage to the first gate line, the control signal is supplied to the control line and the second transistor is put into an on state to put the first transistor into the on state so as to electrically connect the first gate line and the second gate line.

* * * * *